US007047917B2

(12) United States Patent
Akihisa et al.

(10) Patent No.: US 7,047,917 B2
(45) Date of Patent: May 23, 2006

(54) VARIABLE COMPRESSION RATIO MECHANISM

(75) Inventors: Daisuke Akihisa, Susono (JP); Eiichi Kamiyama, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/910,357

(22) Filed: Aug. 4, 2004

(65) Prior Publication Data

US 2005/0028760 A1 Feb. 10, 2005

(30) Foreign Application Priority Data

Aug. 8, 2003 (JP) ..... 2003-289861

(51) Int. Cl.
*F02B 75/04* (2006.01)

(52) U.S. Cl. ..... 123/48 R; 123/78 R

(58) Field of Classification Search ..... 123/48 R, 123/78 R, 78 C, 78 F, 197.4, 197.3, 48 C
See application file for complete search history.

(56) References Cited

U.S. PATENT DOCUMENTS 2,770,224 A 11/1956 Ericson
5,443,043 A * 8/1995 Nilsson et al. ..... 123/48 C

FOREIGN PATENT DOCUMENTS

EP 0 426 540 A1 5/1991
JP A 7-26981 1/1995
JP A 2003-206771 7/2003

* cited by examiner

*Primary Examiner*—Henry C. Yuen
*Assistant Examiner*—Hyder Ali
(74) *Attorney, Agent, or Firm*—Oliff & Berridge, PLC

(57) ABSTRACT

In a variable compression ratio mechanism that serves to change the compression ratio of an internal combustion engine by rotating camshafts so as to cause relative movement between a cylinder block and a crankcase, an oil film forming device forms oil films on the sliding portions of camshafts.

25 Claims, 9 Drawing Sheets

3
2
9b,9c
9a
4
9
5,8
a b,c
5
8
b
a
c
9b
9c

VARIABLE COMPRESSION RATIO MECHANISM

BACKGROUND OF THE INVENTION

1. Field of the Invention

The present invention relates to a variable compression ratio mechanism capable of changing the compression ratio of an internal combustion engine by changing the volume of each combustion chamber thereof.

2. Description of the Related Art

In recent years, there have been proposed techniques capable of changing the compression ratio of an internal combustion engine for the purpose of improving fuel mileage performance, output performance, etc. As such kinds of techniques, there has been proposed one in which a cylinder block and a crankcase are coupled with each other, and camshafts are mounted on the coupling portions thereof, respectively, in such a manner that the compression ratio of the engine is changed by rotating the camshafts so as to move the cylinder block and the crankcase toward and away from each other (for example, see a first patent document: Japanese patent application laid-open No. 2003-206771). A second patent document (Japanese patent application laid-open No. 7-26981) is also cited as a reference document relevant to such a technique.

In the above-mentioned prior art, loads resulting from combustion or firing pressure, the self weight of the cylinder block and the like act between the camshafts and the bearing portions for rotatably supporting the camshafts. In addition, the camshafts in the above-mentioned prior art are not driven to rotate at high speed and at all times during engine operation as the camshafts in the crankshafts or the valve systems.

SUMMARY OF THE INVENTION

The present invention has for its object to provide a technique that can form oil films on sliding portions of camshafts in a variable compression ratio mechanism that serves to change the compression ratio of an internal combustion engine by driving a cylinder block to move relative to a crankcase in accordance with the rotation of the camshafts. As a consequence of which make it possible to decrease in the rotational resistance of the camshafts when the camshafts are driven to rotate.

In order to achieve the above object, the present invention is characterized as its major feature in that in a variable compression ratio mechanism that serves to change the compression ratio of an internal combustion engine by rotating camshafts so as to cause relative movement between a cylinder block and a crankcase, an oil film forming device forms oil films on the sliding portions of camshafts.

Specifically, in one aspect of the present invention, there is provided a variable compression ratio mechanism in which a cylinder block and a crankcase of an internal combustion engine are coupled with each other for relative movement, and one or more camshafts are rotatably mounted on coupling portions at which the cylinder block and the crankcase are coupled with each other, so that the cylinder block and the crankcase are caused to move relative to each other in accordance with the rotation of the camshafts thereby to change the compression ratio of the internal combustion engine, the mechanism being characterized by an oil film forming device that forms oil films between the camshafts and bearing portions rotatably supporting the camshafts.

That is, in the variable compression ratio mechanism according to the present invention, the camshafts, which cause relative movement between the cylinder block and the crankcase, are provided with the oil film forming device that forms oil films between the camshafts and the bearing portions.

With such a construction, it is possible to form oil films of lubricating oil between the surfaces of the camshafts and the bearing portions where an oil film shortage of the lubricating oil is liable to take place. As a result, the oil film shortage of lubricating oil can be prevented, and if such an oil film shortage takes place, oil films can be formed again. Accordingly, an increase in the rotational resistance of the camshafts can be suppressed when the camshafts are driven to rotate, as a consequence of which it is possible to change the compression ratio in a quick and smooth manner.

Here, note that each of the camshafts includes a shaft portion acting as the center of rotation when it rotates, and a cam portion having a cam face formed eccentric or offset with respect to the shaft portion. In addition, the bearing portion includes a bearing for rotatably supporting a corresponding shaft portion, and a cam abutment surface against which a corresponding cam face abuts.

A concrete example of the variable compression ratio mechanism in the present invention may be, for instance, as follows.

That is, the variable compression ratio mechanism includes: a cylinder block having one or more cylinders; a crankcase having a piston and a crankshaft coupled with the piston; and a pair of camshafts disposed between the cylinder block and the crankcase on opposite sides of the cylinders in a parallel relation; and a rotation device in the form of a motor for driving the pair of camshafts to rotate.

The cylinder block is mounted on the crankcase for relative movement.

Each of the camshafts has a shaft portion, a cam portion fixedly secured to the shaft portion, and a movable bearing portion rotatably mounted on the shaft portion.

The cam portion of each camshaft is received in a cam receiving hole formed in one of the cylinder block and the crankcase; the shaft portion of each camshaft, on which the movable bearing portion is rotatably mounted, is received in a shaft receiving hole formed in the movable bearing portion; and the movable bearing portion of each camshaft is received in a bearing receiving hole formed in the other of the cylinder block and the crankcase.

The variable compression ratio mechanism changes the compression ratio in the cylinders by rotating the camshafts under the drive of the motor to cause the cylinder block to move relative to the crankcase in an axial direction of the cylinders.

In addition, provision is made for an oil film forming device that serves to form oil films in at least either of between the cam portions and the cam receiving holes, between the shaft portions and the shaft receiving holes, and between the movable bearing portions and the bearing receiving holes.

That is, each of the camshafts may have a shaft portion, a cam portion fixedly secured to the shaft portion, and a movable bearing portion rotatably mounted on the shaft portion.

Each of the cam portions may be received in a cam receiving hole formed in one of the cylinder block and the crankcase, and each of the shaft portions may be received in a shaft receiving hole formed in a corresponding movable bearing portion, and each of the movable bearing portions may be received in a bearing receiving hole formed in the other of the cylinder block and the crankcase.

With such a construction, in the variable compression ratio mechanism in which the cylinder block is driven to move in an axial direction of the cylinders by means of a simple mechanism, provision may be further made for an oil film forming device that serves to form oil films at least either between the cam portions and the cam receiving holes, between the shaft portions and the shaft receiving holes, and between the movable bearing portions and the bearing receiving portions or holes.

In a concrete example, each of the camshafts may include a cam portion, a shaft portion and a movable bearing portion as stated above, and the movable bearing portion may include a cam receiving hole, a shaft receiving hole, and a bearing receiving hole.

In such a mechanism, relative movement of a large stroke between the cylinder block and the crankcase becomes possible with a simple mechanism, but there might take place oil film shortages, in addition to between the cam portion of the camshafts and the cam receiving holes, between the shaft portions of the camshafts and the shaft receiving portions and between the movable bearing portions and the bearing receiving holes. Accordingly, further attention is required so as to prevent such oil film shortages.

By the provision of the oil film forming device in such a mechanism, there becomes more remarkable the advantageous effect of suppressing an increase in the rotational resistance of the camshafts thereby to enable a quick and smooth changing of the compression ratio.

Here, as a method of forming oil films between the camshafts and the bearing portions, there may be adopted a method of moving the camshafts relative to the bearing portions. In the case of occurrence of an oil film shortage, lubricating oil often moves from between the camshafts and the bearing portions, which are actually performing relative sliding movement, to other places, so there will be no oil films formed between the camshafts and the bearing portions. Accordingly, by making the camshafts move relative to the bearing portions, the lubricating oil that has moved from between the camshafts and the bearing portions to other places can be returned to between them, whereby oil films can be formed between the camshafts and the bearing portions.

By using this method, there is no need to freshly supply lubricating oil to between the camshafts and the bearing portions, and it becomes possible to suppress an increase in the rotational resistance of the camshafts thereby to enable the compression ratio of the engine to be changed with simple control in a quick and smooth manner without consuming lubricating oil wastefully.

Here, firstly, as a concrete method of moving the camshafts relative to the bearing portions so as to form oil films between the camshafts and the bearing portions, there may be employed a method of driving the camshafts to rotate reciprocatingly by means of a rotation device. In this regard, note that rotating the camshafts reciprocatingly means a movement in which the camshafts are first driven to rotate a predetermined angle in one rotational direction, and are then caused to rotate again to their original positions in the other or opposite direction.

In case where the camshafts are driven to rotate while being placed in contact with the shaft receiving portions, defective lubrication will be caused due to the fact that the thickness of the oil films of lubricating oil in the sliding portions of the camshafts and the bearing receiving portions is reduced below a predetermined thickness. In such a condition, if the camshafts are forced to continue rotating, the area of thin oil films increases, giving rise to a fear that a shortage of oil films might be caused to lock the camshafts against rotation.

Accordingly, in order to prevent such trouble, it is effective that the camshafts are once driven to rotate in a direction opposite to the direction in which the camshafts have been rotating up to then before the occurrence of such locking due to the shortage of oil films, so that the portions of the camshafts facing areas where oil films become thinned are forced to move to areas where a proper thickness of oil films is kept. With such a measure, it is possible to form oil films of a proper thickness in the areas where the oil films has been thinned. Thereafter, at a time when proper oil films have been formed in the areas of the thinned oil films, the rotational angles of the camshafts are returned to their original positions, and then the camshafts are started to driven to rotate again in the intended or original direction, thereby making it possible to prevent the camshafts from being locked due to oil film shortages.

On the other hand, in case where the camshafts are stopped or out of operation for a long period of time, loads such as the self weight of the cylinder block, the combustion pressure in the cylinders, etc., are applied to between the camshafts and the bearing portions for an extended period of time, so the oil films between the camshafts and the bearing portions tend to become more thinner. If this state is left as it is, there will be a fear that a shortage of oil films might be generated in between the camshafts and the bearing portions. Even in such a state, however, by reciprocatingly rotating the camshafts in an appropriate manner, it is possible to move the portions of the camshafts facing the areas of thinned oil films to the areas where a proper thickness of oil films is kept.

As a consequence, oil films of a proper thickness can be formed on those portions of the camshafts.

Here, note that the frequency or the number of times of such reciprocating rotations is not limited to one but may be a plurality of times. By performing the reciprocating rotation of the camshafts a plurality of times, wedging film action or squeezing action can be induced to the lubricating oil films between the camshafts and the bearing portions, so that oil films of a proper thickness can be formed between the camshafts and the bearing portions in a more reliable manner.

Secondly, as a method of forming oil films between the camshafts and the bearing portions, there may be adopted a method of reciprocating the camshafts in a direction substantially perpendicular to the axial direction of the camshafts.

Here, it should be recalled that areas of thinned oil films might exist between the camshafts and the bearing portions, as previously stated. According to this method, however, the camshafts are driven to reciprocate by in a direction substantially perpendicular to the axial direction of the camshafts, so that gaps or clearances between the camshafts and the bearing portions in these areas are increased to permit the lubricating oil therearound to move into the areas of thinned oil films. In this method, thereafter, when these gaps or clearances are returned to their original sizes, the lubricating oil having moved there are caused to spread, thus forming oil films of a proper thickness. Here, note that the reciprocating movement in this case is performed within the range of the amount of play between the camshafts and the bearing portions.

As a concrete method of reciprocating the camshafts in a direction substantially perpendicular to the axial direction of the cylinders, there may be adopted a method of forcing objects each having an appropriate mass to strike or collide under inertia against the camshafts in a direction substantially perpendicular to the axial direction of the camshafts by momentarily applying a voltage to actuators such as piezo-electric elements, etc. According to this method, there is obtained an advantageous effect that even in the case where an oil film shortage has already occurred to lock the camshafts against rotation, the locking can be released by applying impacts to the camshafts in a direction substantially perpendicular to the axial direction of the camshafts.

Here, note that when impacts are applied to the camshafts, the camshafts may be caused to move while being inclined such as by applying impacts to the opposite ends of each camshaft with a difference in time.

In addition, note that the frequency or the number of times of such reciprocating movements is not limited to one, but a plurality of reciprocating movements may be carried out continuously, whereby oil films can be formed more effectively between the camshafts and the bearing portions. Further, even when an oil film shortage has already taken place to lock the camshafts against rotation, such locking can be released effectively.

Thirdly, as a method of forming oil films between the camshafts and the bearing portions, there may be adopted a method in which at least parts of those portions which constitute the camshafts and the bearing portions, such as the cam portions and the cam receiving holes, the shaft portions and the shaft receiving portions, the movable bearing portions and the bearing receiving portions, etc., are formed into tapered configurations having an equal angle of taper or inclination, and the camshafts are driven to axially move back and forth.

That is, by driving the camshafts to move back and forth, i.e., by first moving the camshafts, which have tapered portions rotatably supported by corresponding tapered portions of the bearing portions, in a direction to increase the diameters of the tapered portions and then returning the camshafts to their original positions, the gaps or clearances between the camshafts and the bearing portions can be temporarily increased or expanded. In this manner, lubricating oil can be moved into between the camshafts and the bearing portions, in which oil films become thinned, from therearound. According to this method, too, the following advantageous effects are provided. That is, oil films of a proper thickness can be formed, and even in cases where an oil film shortage has already taken place and the camshafts are locked against rotation, such locking can be released.

In this connection, though all of the camshafts and the bearing portions can be formed into tapered configurations, only those parts of them which are liable to be subjected to loads resulting from the self weight of the cylinder block, combustion pressure, etc., may be formed into tapered configurations. In this case, it is possible not only to solve the problem of the present invention of suppressing a shortage of oil films between the camshafts and the bearing portions but also to suppress an increase in the manufacturing man hours of the camshafts to a minimum.

As a concrete method of driving the camshafts to axially move back and forth, there may be adopted a method in which, similar to the above-mentioned cases, a pair of objects each having an appropriate mass are arranged at the opposite ends, respectively, of each camshaft to be moved back and forth, so that the objects are provided with inertia and forced to strike or collide against each corresponding camshaft from the axial direction thereof by momentarily impressing a voltage on actuators such as piezo-electric elements or the like which act to apply impacts to the objects, respectively. This method is particularly effective in the case of moving objects under friction such as the camshafts in the present invention, and is able to perform fine control on the amount of movement of each camshaft.

Further, loads such as the self weight of the cylinder block, combustion or firing pressure in the cylinders, etc., are applied to between the camshafts and the bearing portions, as previously stated. Accordingly, when the camshafts are caused to move axially in a direction to increase the diameters of their tapered portions, the cylinder block, etc., moves in a direction substantially perpendicular to the axial detection of the camshafts (i.e., a direction not to increase or expand the gaps or clearances between the camshafts and the bearing portions) so as to follow the movements of the camshafts. In contrast to this, as a method of moving the camshafts in the axial direction, there may be adopted a method in which objects are provided with inertia and forced to strike or collide against the camshafts from the axial direction thereof by momentarily impressing a voltage on actuators such as piezo-electric elements, etc. In this case, the camshafts can be driven to move at a large acceleration. As a consequence, the gaps or clearances between the camshafts and the bearing portions can be increased or expanded to a satisfactory extent while overcoming the motion of the cylinder block, etc., which prevents widening or expansion of the gaps or clearances between the camshafts and the bearing portions.

As another method capable of forcing the camshafts to move back and forth at a large acceleration, there may be adopted a method in which a pair of cams for back-and-forth movement are separately arranged at the opposite ends of each camshaft, and the cams for back-and-forth movement are driven to rotate at high speed so that they are caused to strike or collide against the opposite ends of each corresponding camshaft.

Furthermore, though the camshafts, when driven to move in the direction to increase the diameters of their tapered portions, can be moved at a large acceleration, a particularly large acceleration is not required in the movements of the camshafts when they are returned to their original positions. Therefore, as a concrete method for returning the camshafts to their original positions, there may be employed, other than the above-mentioned ones, a method utilizing repulsive forces produced by electromagnets or a method utilizing the resilient forces of springs or the like so as to return the camshafts to their own their positions.

Preferably, the distance of the back-and-forth movement in this method, though determined by the relation thereof with the tapered configurations, may be in the range of from about several tens μm to about several hundreds μm. In addition, the number of back-and-forth movements is not limited to one time, but may be a plurality of times.

Still further, in this method, the bearing portions may be driven to move back and forth instead of moving the camshafts back and forth. In this case, too, advantageous effects similar to the case of moving the camshafts back and forth can be obtained.

Besides, in the present invention, the variable compression ratio mechanism may further comprise: a temperature detecting device that detects a temperature in the vicinity of the camshafts; and a stop position correcting device that corrects an axial stop position of each of the camshafts or the bearing portions therefor in accordance with the temperature detected by the temperature detecting device.

Here, in the variable compression ratio mechanism, if the temperature in the vicinity of the camshafts is raised due to the heat of combustion in the cylinders, the sizes of gaps or clearances between the camshafts and the bearing portions will be deviated from their optimal values owing to a difference in the coefficient of linear expansion between the materials constituting the camshafts and the materials constituting the bearing portions, so in some cases, the gaps or clearances might be lost, thus causing locking of the camshafts.

In view of the above, preferably, a temperature detecting device may be provided for detecting the temperature in the vicinity of the camshafts, and the axial stop positions of the camshafts may be corrected by moving the respective tapered portions of the camshafts, which are rotatably engaged with the corresponding tapered portions of the bearing portions, in the axial direction in accordance with the temperature in the vicinity of the camshafts detected by the temperature detecting device. Thus, appropriate gaps or clearances can be maintained between the camshafts and the bearing portions at least for preventing locking of the camshafts. With such an arrangement, the influence of the temperature in the vicinity of the camshaft on the occurrence of oil film shortage can be suppressed. Further, if the camshafts are caused to move back and forth thereby to form oil films between the camshaft and the bearing portions in addition to the above control being performed, an increase in the rotational resistance of the camshafts can be suppressed more reliably, as a result of which it is possible to change the compression ratio in a more reliable, quick and smooth manner.

In this case, preferably, the relation between the temperature in the vicinity of the camshafts and the amount of movement of the camshafts necessary to prevent the locking thereof may be experimentally obtained and made into a map beforehand. Then, the temperature in the vicinity of the camshafts may be detected at a prescribed time, and by reading from the map an amount of movement of the camshafts required to maintain sufficient gaps or clearances between the camshafts and the bearing portions at the detected temperature, the camshafts may be driven to move by using the data thus read out. By doing so, necessary minimum gaps or clearances can always be maintained between the camshaft and the bearing portions, and as a consequence, it is possible to reduce the influence of the temperature in the vicinity of the camshafts on the oil films formed between the camshafts and the bearing portions.

Preferably, in the present invention, the oil film forming device may be controlled in such a manner that it acts to form oil films between the camshafts and the bearing portions when the camshafts begin to rotate so as to change the compression ratio of the internal combustion engine.

With such control, when the camshafts start rotating so as to change the compression ratio, the camshafts can be driven to rotate after oil films have been formed between the camshafts and the bearing portions without fail. As a result, an oil film shortage between the camshafts and the bearing portions does not take place easily during rotation of the camshafts, thus making it possible to suppress locking of the camshafts. In this regard, preferably, in the case of such control being performed, particularly in case where oil films are formed by driving the camshafts to rotate reciprocatingly, such reciprocating rotation may be effected by first driving the camshafts to rotate a predetermined angle in a direction to change the compression ratio and then returning them to their original or former positions. This is because if the reciprocating rotation is carried out by first driving the camshafts to rotate a predetermined angle in a direction opposite to the direction intended to change the compression ratio, and then returning them to their original positions, the compression ratio of the internal combustion engine might be temporarily changed to a direction opposite to the direction in which the compression ration is intended to be changed.

Preferably, in the present invention, the oil film forming device may be controlled in such a manner that it serves to form oil films between the camshafts and the bearing portions when the camshafts are driven to rotate so as to change the compression ratio of the internal combustion engine.

Specifically, for example, in case where the camshafts are driven to rotate so as to change the compression ratio of the internal combustion engine, the oil film forming device may be controlled to form oil films at the time when a predetermined time has elapsed after the camshafts start rotating, or when the camshafts have rotated a predetermined angle.

At this time, preferably, a period of time, which is shorter than the time from the start of rotation of the camshafts for which there is a possibility that an oil film shortage can take place, may be set as the predetermined time, or an angle of rotation, which is smaller than the angle of rotation from the start of rotation of the camshafts for which there is a possibility of the occurrence of an oil film shortage, may be set as the predetermined angle. By doing so, an oil film shortage between the camshafts and the bearing portions does not take place easily during rotation of the camshafts, and as a result, it is possible to suppress an increase in the rotational resistance of the camshafts as well as the occurrence of locking of the camshafts.

Preferably, in the present invention, for example, when the camshafts are driven to rotate so as to change the compression ratio of the internal combustion engine, control may be carried out in such a manner that oil films are formed each time a predetermined time elapses or each time the camshafts rotate a predetermined angle.

At this time, preferably, a period of time, which is shorter than the time from the start of rotation of the camshafts for which there is a possibility that an oil film shortage can take place, may be set as the predetermined time, or an angle of rotation, which is smaller than the angle of rotation from the start of rotation of the camshafts for which there is a possibility of the occurrence of an oil film shortage, may be set as the predetermined angle. Thus, oil films can be formed any number of times while the camshafts are rotating, so that an oil film shortage between the camshafts and the bearing portions does not take place easily during rotation of the camshafts. Consequently, it is possible to suppress an increase in the rotational resistance of the camshafts as well as the occurrence of locking of the camshafts in a more reliable manner.

Preferably, in the present invention, for example, in case where the camshafts are driven to rotate so as to change the compression ratio of the internal combustion engine, the oil film forming device may be controlled in such a manner that it monitors the driving torques of the camshafts during rotation thereof, and forms oil films between the camshafts and the bearing portions when the driving torque becomes a predetermined value or more.

Here, preferably, the predetermined value or driving torque, which is a criteria for determining whether oil films are to be formed, may be set based on and smaller than the torque value that is experimentally obtained as a driving torque at the time when an oil film shortage takes place between the camshafts and bearing portions. In addition, as a method for detecting the driving torque of each camshaft, there may be adopted a method of detecting the value of the current supplied to the rotation device in the form of a motor that drives the camshaft. Also, for this purpose, there may be employed a method in which resilient members such as torsion springs are interposed between the rotating shaft of the motor and the camshafts, respectively, and the angle of torsion of each torsion spring is detected by a photoelectric sensor or the like.

With the above methods, in the variable compression ratio mechanism according to the present invention, when the driving torque of each camshaft becomes the predetermined value or above during the time when the camshafts are being driven to rotate for changing the compression ratio, a determination can be made that an oil film shortage is going to take place between the camshafts and the bearing portions. At such a time, oil films are formed by means of the oil forming device. Thus, since oil films can be formed by detecting that an oil film shortage is actually about to take place, it is possible to suppress the oil film shortage. Also, it is possible to avoid the waste of further forming oil films even with the presence of sufficient oil films between the camshafts and the bearing portions.

Preferably, in the present invention, the oil film forming device is controlled in such a manner that it acts to form oil films between the camshafts and the bearing portions at each predetermined time interval during the time when the rotation of the camshafts for changing the compression ratio of the internal combustion engine is stopped.

With such control, even if the camshafts continue to be stopped for a long period of time, during which loads have been applied to between the camshafts and the bearing portions over an extended period of time owing to the self weight of the cylinder block and the pressure of combustion or firing in the cylinders so that the thickness of the oil films in those portions is thinned or decreased, fresh oil films can be formed between the camshafts and the bearing portions at every predetermined time interval by means of the oil film forming device. Therefore, it is possible to avoid the situation where an oil film shortage takes place while the camshafts are stopped, whereby the camshafts are unable to be rotated smoothly.

Here, regarding the predetermined time as mentioned above, it is first experimentally determined in advance how much time has elapsed until a shortage of oil films between the camshafts and the bearing portions becomes liable to occur when the camshafts continue to receive the above-mentioned loads with their rotation being stopped, and then the predetermined time may be appropriately set on the condition that it is shorter than the period of time thus determined. Thus, even during the stopped time of the camshafts, an oil film shortage between the camshafts and the bearing portions can be prevented more reliably, and it is possible to avoid the waste of repeating the operation of forming oil films between the camshafts and the bearing portions at times more than necessary.

Preferably, in the present invention, in cases where oil films are formed between the camshafts and the bearing portions by driving the camshafts to rotate reciprocatingly during the time when the rotation of the camshafts for changing the compression ratio of the internal combustion engine is stopped, such an oil film forming operation is carried out only when the internal combustion engine is in a decelerating state. That is, in cases where oil films are formed by reciprocatingly rotating the camshafts, the compression ratio of the internal combustion engine is changed even by the reciprocating rotation of the camshafts. As a result, adverse influence might be exerted on the operating condition of the engine. Therefore, it is preferred that the formation of the films be performed only at the time of deceleration in which the influence on the engine operating condition will be small even if the compression ratio of the internal combustion engine changes. In this manner, it is possible to form oil films between the camshafts and the bearing portions without influencing the engine operating condition.

In another aspect, the above-mentioned object of the present invention can be achieved by a method of changing the compression ratio of an internal combustion engine in which a cylinder block and a crankcase of the internal combustion engine are coupled with each other for relative movement, and a pair of camshafts are rotatably mounted on coupling portions at which the cylinder block and the crankcase are coupled with each other, so that the cylinder block and the crankcase are caused to move relative to each other in accordance with the rotation of the camshafts, the method being characterized by: a relative movement step for rotating the camshafts thereby to move the cylinder block and the crankcase relative to each other; an oil film shortage estimating step for estimating an oil film shortage between the camshafts and the bearing portions therefor; and an oil film forming step for forming oil films between the camshafts and the bearing portions therefor by driving the camshafts to move relative to the bearing portions therefor when an occurrence of the oil film shortage is estimated in the oil film shortage estimating step.

Here, in the above-mentioned relative movement step, the compression ratio is changed by relative movement between the cylinder block and the crankcase, and in the oil film shortage estimating step, it is estimated whether an oil film shortage occurs between the camshafts and the bearing portions therefor. Then, when it is estimated that the oil film shortage takes place in the oil film shortage estimating step, the oil film forming step is carried out so that oil films are formed between the camshafts and the bearing portions therefor by driving the camshafts to move relative to the bearing portions therefor.

In this manner, it is possible to form oil films between the camshafts and the bearing portions therefor when an oil film shortage takes place between the camshafts and the bearing portions. As a result, it is possible to perform quick and smooth relative movement between the cylinder block and the crankcase.

Here, in the oil film shortage estimating step, as stated above, when the predetermined time has elapsed after the camshafts begin to rotate in the relative movement step, or when the camshafts have rotated a predetermined angle, it may be estimated that an oil film shortage has occurred. Alternatively, the driving torque of each camshaft is monitored in the relative movement step, and when the driving torque becomes a predetermined value or above, it may be estimated that an oil film shortage has occurred. Further, the occurrence of an oil film shortage may be estimated when a predetermined time has elapsed at times other than in the relative movement step, i.e., during the time when the rotation of the camshafts for changing the compression ratio of the internal combustion engine is stopped.

Moreover, the oil film forming step may be a step for driving the camshafts to rotate reciprocatingly, or a step for driving the camshafts to reciprocate in a direction substantially perpendicular to the axial direction of the camshafts, or a step for driving the camshafts or the bearing portions therefor, at least parts of which are formed into tapered configurations, to move back and forth in the axial direction.

Here, note that the above-mentioned devices for solving the problem of the present invention can be used in any combination thereof.

According to the present invention, in a variable compression ratio mechanism, an oil film shortage between camshafts and bearing portions can be suppressed, thereby making it possible to suppress an increase in the rotational resistance of the camshafts. As a result, the present invention can contribute to achieving a quick and smooth changing of the compression ratio of an internal combustion engine.

The above and other objects, features and advantages of the present invention will become more readily apparent to those skilled in the art from the following detailed description of preferred embodiments of the present invention taken in conjunction with the accompanying drawings.

BRIEF DESCRIPTION OF THE DRAWINGS

FIGS. 2A through 2C are cross sectional views respectively showing processes of the movement of a cylinder block relative to a crankcase in the internal combustion engine according to the first embodiment of the present invention, wherein FIG. 2A is a view showing the state in which the outer peripheries of all cam portions and movable bearing portions coincide with one another as viewed from extensions of the shaft portions; FIG. 2B is a view showing the state in which the shaft portions are driven to rotate in directions of arrows, respectively, from the state of FIG. 2A; and FIG. 2C is a view showing the state in which the amount of movement of the cylinder block becomes a maximum.

FIGS. 3A through 3C are cross sectional views showing the states of an oil film formed between a cam portion and a cam receiving hole according to the first embodiment of the present invention, wherein FIG. 3A is a view showing the case where lubricating oil is retained around the cam portion in a proper manner; FIG. 3B is a view showing the case where the thickness of the oil film decreases during rotation of the cam portion; and FIG. 3C is a view showing the case where the cam portion is driven to rotate in the opposite direction.

DESCRIPTION OF THE PREFERRED EMBODIMENTS

Figure 1:
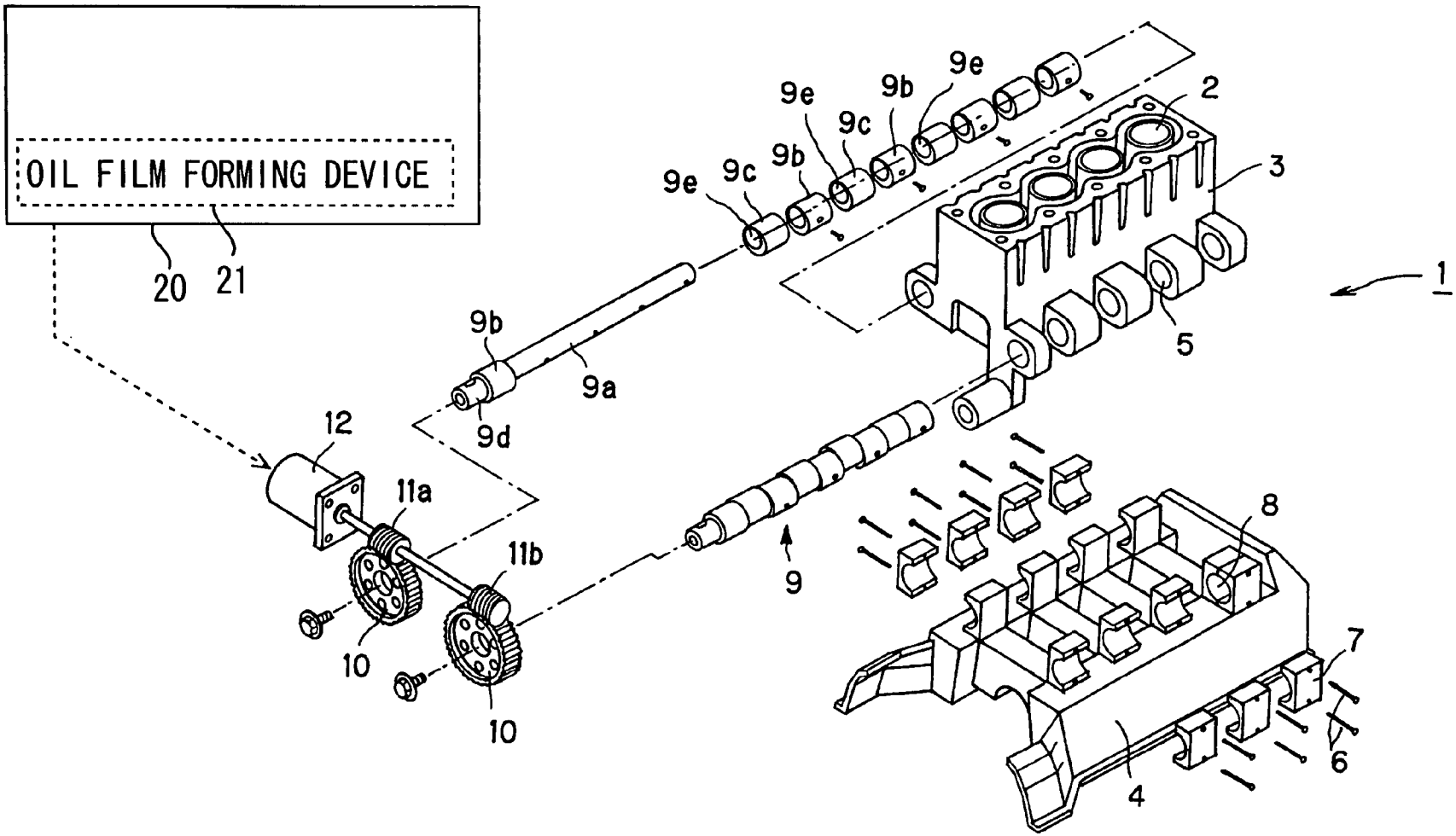
FIG. 1 is an exploded perspective view showing the schematic construction of essential parts of an internal combustion engine according to a first embodiment of the present invention.

Now, preferred embodiments of the present invention will be described below in detail while referring to the accompanying drawings.

[Embodiment 1]

An internal combustion engine, which is generally designated at reference numeral 1 and will be described below, is a variable compression ratio type internal combustion engine whose compression ratio is changed by moving a cylinder block 3 with a plurality of cylinders 2 relative to a crankcase 4 coupled with unillustrated pistons in the axial direction of the cylinders.

First of all, reference will be made to the construction of the variable compression ratio type internal combustion engine according to a first embodiment of the present invention by using FIG. 1. As shown in FIG. 1, the cylinder block 3 has a plurality of projected portions formed at the lower opposite sides thereof, with a cam receiving hole 5 being formed in each of the projected portions. Each of the cam receiving holes 5 takes a circular or round shape in cross section, and they are formed in such a manner that they are disposed substantially perpendicular to the axial direction of the cylinders 2 and in parallel to the direction in which the plurality of cylinders 2 are arranged in a row. All the cam receiving holes 5 at each side of the cylinder block 3 are aligned on the same line or axis, and a pair of axes of the cam receiving holes 5 at the opposite sides of the cylinder block 3 are arranged in parallel to each other.

The crankcase 4 has a plurality of upright wall portions formed in two rows so as to be located between the plurality of projected portions in which the cam receiving holes 5 are formed. Each of the upright wall portions has a semicircular concave or recessed portion formed on its surface directed outwardly of the crankcase 4. In addition, for each upright wall portion, there is provided a cap 7 with a concave or recessed portion that is adapted to be attached to a corresponding upright wall portion by means of a bolt 6. When each cap 7 is attached to a corresponding upright wall portion, there is formed a round or circular bearing receiving hole 8 whose shape is the same as that of each cam receiving hole 5 as mentioned above.

When the cylinder block 3 is attached to the crankcase 4, the plurality of bearing receiving holes 8 are formed in such a manner that they are arranged substantially perpendicular to the axial direction of the cylinders 2 and in parallel to the direction of arrangement of the plurality of cylinders 2, as in the case of the cam receiving holes 5. The plurality of bearing receiving holes 8 are also formed at the opposite sides of the cylinder block 3 in two rows, and each row of the bearing receiving holes 8 at one side of the cylinder block 3 are arranged or aligned on the same line or axis. Also, a pair of axes of the bearing receiving holes 8 at the opposite sides of the cylinder block 3 are parallel to each other, and the distance between the cam receiving holes 5 on the opposite side and the distance between the bearing receiving holes 8 on the opposite side are the same with respect to each other.

The two rows of cam receiving holes 5 and the two rows of bearing receiving holes 8 are arranged alternately with respect to each other and inserted by camshafts 9, respectively. As shown in FIG. 1, each of the camshafts 9 includes a shaft portion 9*a*, a plurality of cam portions 9*b* each having a cam profile of a right or complete circular shape fixedly secured to the shaft portion 9*a* in an eccentric or offset relation with respect to the central axis thereof, and a plurality of movable bearing portions 9*c* each having the same outer shape as that of each cam portion 9*b* and rotatably mounted on the shaft portion 9*a* in an alternate relation with respect to the cam portions 9*b*. Each of the movable bearing portions 9*c* has a shaft receiving hole 9*e* formed therein, into which the shaft portion 9*a* of the camshaft 9 is inserted so as to be rotatably supported by the movable bearing portions 9*c*. Additionally, the pair of camshafts 9 have a mirror-image relation with respect to each other. Moreover, each of the camshafts 9 is formed at its one end with a mounting portion 9*d* for a gear 10 to be described later. Each mounting portion 9*d* has its center arranged eccentric to the central axis of the associated shaft portion 9*a* but concentric to the common central axis of the associated cam portions 9*b*.

The movable bearing portions 9*c* are also arranged in an eccentric or offset relation with respect to the associated shaft portion 9*a*, with an amount of eccentricity or offset being the same as that of the cam portions 9*b*. In addition, the directions of eccentricity or offset of the plurality of the cam portions 9*b* of each camshaft 9 are the same, and the outer shape of each movable bearing portion 9*c* is the same complete circle as that of each cam portion 9*b*. Thus, the outer surfaces of the plurality of the cam portions 9*b* and the outside surfaces of the plurality of the movable bearing portions 9*c* can be made to coincide with each other by rotating the movable bearing portions 9*c*.

A pair of gears 10 are mounted on one ends of the shaft portions 9*a* of the camshafts 9, respectively, and worm gears 11*a*, 11*b* are placed in meshing engagement with the pair of gears 10, respectively, fixedly secured to the one ends of the pair of camshafts 9. The worm gears 11*a*, 11*b* are mounted on one output shaft of a single motor 12, and have spiral grooves, respectively, which turn in directions opposite to each other, so that when the motor 12 is energized to rotate, the pair of camshafts 9 are driven to rotate in the opposite directions through the gears 10, respectively. At this time, the motor 12, being fixedly secured to the cylinder block 3, is caused to move integrally with the cylinder block 3.

An electronic control unit (ECU) 20 for controlling the internal combustion engine 1 is provided in conjunction with the engine 1. This ECU 20 is equipped with a CPU, storage elements such as a ROM, a RAM, etc., for storing various programs, data, maps, etc., to be described later, and serves to control not only the operating condition of the engine 1 in accordance with the operating state of a vehicle, on which the engine 1 is installed, and driver's requirements, but also the compression ratio of the engine 1. Here, note that an oil film forming device 21, which will be described later and serves to smoothen the rotations of the camshafts 9, is constituted by a program stored in the ROM inside the ECU 20.

A variety of sensors for detecting the operating condition of the internal combustion engine 1 are connected to the ECU 20 through electric wiring so that the output signals from these sensors can be input to the ECU 20. On the other hand, the motor 12 and the like in this embodiment is also connected to the ECU 20 through electric wiring so that the motor 12 is energized to rotate under the control of a command from the ECU 20, thereby changing the compression ratio of the internal combustion engine 1.

Figures 2A, 2B, 2C:
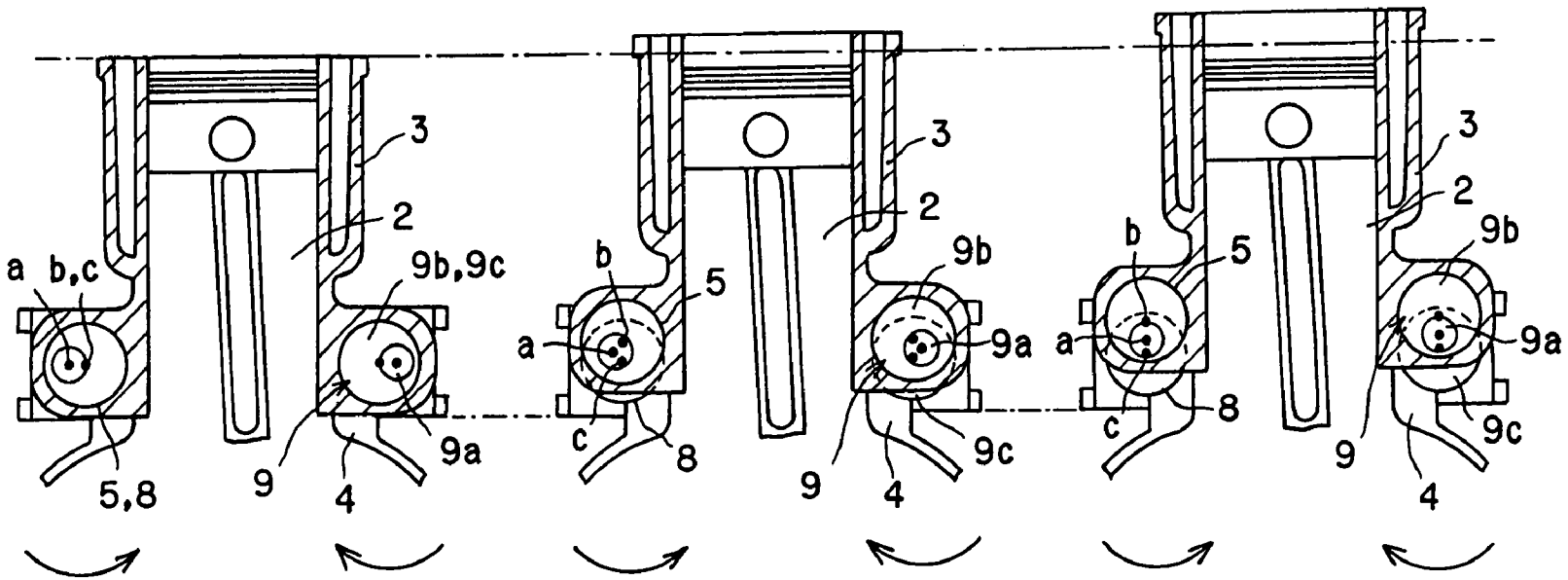

Next, reference will be made in detail to a method of controlling the compression ratio of the internal combustion engine 1 as constructed above. FIGS. 2A through 2C show cross sectional views representing the relation between the cylinder block 3, the crankcase 4 and the camshafts 9 arranged therebetween. In these figures, the central axis of each shaft portion 9*a* is denoted at a, the center of each cam portion 9*b* is denoted at b, and the center of each movable bearing portion 9*c* is denoted at c. FIG. 2A illustrates the state where the outer peripheries of all the cam portions 9*b* and the movable bearing portions 9*c* coincide with each other, as viewed along extensions of the shaft portions 9*a*. At this time, the pair of shaft portions 9*a* are positioned at locations inside the cam receiving holes 5 and the bearing receiving holes 8 and radially outwardly of the common central axis thereof.

FIG. 2B illustrates the state where the motor 12 is energized to drive the shaft portions 9*a* to rotate from their states of FIG. 2A in directions indicated by arrows, respectively. At this time, since a deviation is generated between the directions of eccentricity or offset between the cam portion 9*b* and the movable bearing portion 9*c* with respect to the shaft portion 9*a*, the cylinder block 3 can be made to slide to the top dead center side with respect to the crankcase 4. At the instant when the camshafts 9 have been rotated to the states illustrated in FIG. 2C, the amount of sliding movement of the cylinder block 3 becomes a maximum, which is twice as large as the amount of eccentricity or offset of each cam portion 9*b* or movable bearing portion 9*c*. The cam portions 9*b* and the movable bearing portions 9*c* rotate in the cam receiving holes 5 and the bearing receiving holes 8, respectively, permitting the positions of the shaft portions 9*a* to move in the cam receiving holes 5 and in the bearing receiving holes 8.

By using the above-mentioned mechanism, the cylinder block 3 can be moved relative to the crankcase 4 in the axial direction of the cylinders 2, thereby making it possible to control the compression ratio in a variable manner. Here, note that the step or process of energizing the motor 12 to rotate the shaft portions 9*a* in the directions of the arrows shown in FIGS. 2A through 2C thereby to slide the cylinder block 3 to the top dead center side with respect to the crankcase 4 as stated above corresponds to a relative movement step in this embodiment.

In the above-mentioned mechanism, when the compression ratio of the internal combustion engine 1 is changed. the shaft portions 9*a* and the shaft receiving holes 9*e*, the cam portions 9*b* and the cam receiving holes 5, the movable bearing portions 9*c* and the bearing receiving holes 8 perform relative rotational movements while mutually sliding with respect to one another, as stated above. In order to perform the rotational movements in a smooth and quick manner, lubricating oil is supplied to gaps or clearances between the shaft portions 9*a* and the shaft receiving holes 9*e*, the cam portions 9*b* and the cam receiving holes 5, the movable bearing portions 9*c* and the bearing receiving holes 8, but defective rotation might be generated in the compression ratio changing process. A generation mechanism for such defective rotation is generally considered as follows.

Here, note that the words "between camshafts 9 and bearing portions 18" means "between the shaft portions 9*a* and the shaft receiving holes 9*e*", "between the cam portions 9*b* and the cam receiving holes 5", "between the movable bearing portions 9*c* and the bearing receiving holes 8".

That is, loads such as the self weight of the cylinder block 3, the combustion or firing pressure generated in the cylinders 2, etc., are constantly applied to the gaps or clearances between the camshafts 9 and the bearing portions 18. In addition, since the camshafts 9 repeats a stopped or non-rotation state and a rotation state of rotating at low speeds, it is difficult for the lubricating oil supplied to the gaps or clearances between the camshafts 9 and the bearing portions 18 to be evenly distributed to the entire gaps or clearances. Besides, the duration for which the loads concentrate on parts of the gaps or clearances is apt to be prolonged. If a sufficient amount of lubricating oil becomes unable to be supplied to the parts of the gaps or clearances on which the loads are concentrated, the thickness of oil films in these parts becomes thin, thus giving rise to a shortage of oil films depending upon the circumstances. In case where the thickness of the oil films between the gaps or clearances between the camshafts 9 and the bearing portions 18 becomes thin, or in case where a shortage of the oil films takes place, the rotational resistance of the camshafts 9 increases, resulting in the generation of defective rotation. When such defective rotation of the camshafts 9 occurs, there arises a problem of excessive increase in the electric power consumption of the motor 12. In addition, if the condition of such an oil film shortage as stated above continues, there might take place a so-called lock phenomenon in which the camshafts 9 become unable to rotate or locked against rotation, thus making it impossible to change the compression ratio of the internal combustion engine 1.

Accordingly, in this embodiment, when the compression ratio of the internal combustion engine 1 is changed by rotating the camshafts 9, the camshafts 9 are driven to reciprocatingly rotate so as to form oil films during the rotation of the camshafts 9 when a predetermined time has elapsed from the start of rotation of the camshafts 9. By reciprocatingly rotating the camshafts 9 at a time during the rotation of the camshafts 9, it is possible to form oil films between the camshafts 9 and the bearing portions 18. As a result, an oil film shortage between the camshafts 9 and the bearing portions 18 can be suppressed in an effective manner.

Figure 3A:
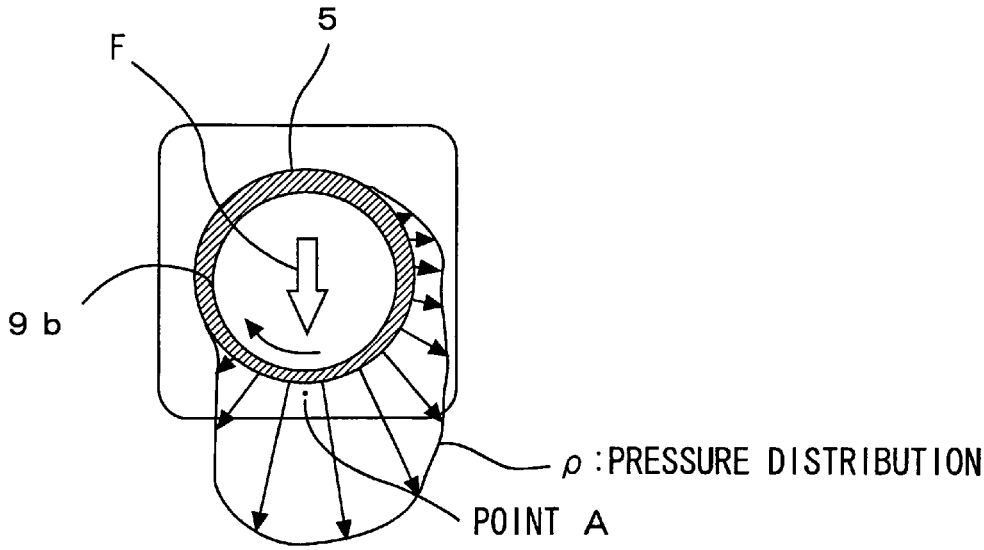
Figure 3B:
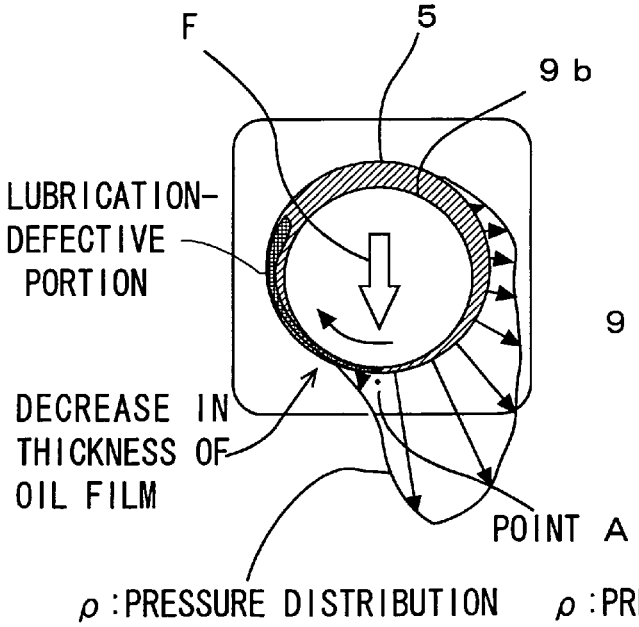
Figure 3C:
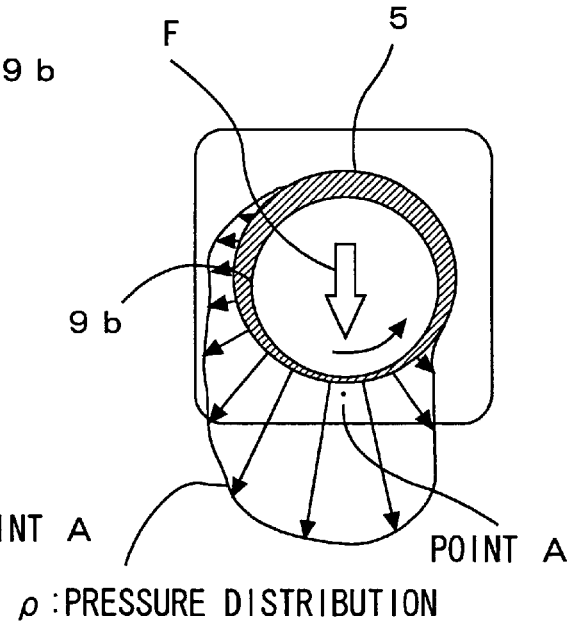

Here, reference will be made in detail to the principle for this by using FIGS. 3A through 3C. FIGS. 3A through 3C are cross sectional views that illustrate the states of an oil film formed between a cam portion 9*b* and a corresponding cam receiving hole 5. Herein, though a description will be made to the case where the cam portion 9*b* is driven to rotate in the cam receiving hole 5, such a description is similarly applicable to the case where the shaft portions 9*a* are driven to rotate in the shaft receiving holes 9*e* or the movable bearing portions 9*c* are driven to rotate in the bearing receiving portions 8.

In FIG. 3A, a load F due to the self weight of the cylinder block 3 and the pressure generated by combustion or firing in the cylinders 2 is applied to the cam portion 9*b*, and hence the thickness of the oil film around the camshaft 9 and the distribution of the pressure applied to the oil film during the rotation of the camshaft 9 become as illustrated in FIG. 3A. If lubricating oil is properly held or retained around the cam portion 9*b* as shown in FIG. 3A, a sufficient pressure of the lubricating oil will be generated even at point A at which sliding surface pressure becomes the highest, thus making it possible to keep fluid lubrication.

However, in case where the thickness of the oil film at point A is decreased during the rotation of the cam portion 9*b*, as shown in FIG. 3B, defective lubrication will take place. Here, if the cam portion 9*b* is continued to further rotate in the same direction, it advances to a lubrication-defective portion side, as a result of which the state of a sufficient oil film being not obtained at point A continues, so there is a possibility that the camshaft 9 might be locked against rotation due to a shortage of oil film.

Accordingly, as shown in FIG. 3C, the cam portion 9*b* is caused to rotate in a direction opposite to the direction in which it has been rotating up to that time, so that the cam portion 9*b* is once returned back to an area where a proper oil film has been kept, thereby avoiding a shortage of oil film. Then, after the counter or reverse rotation of the cam portion 9*b* has been carried out to a certain extent to avoid defective lubrication, the cam portion 9*b* is driven to rotate again in an originally intended direction to the former or original position. Thereafter, further rotation of the cam portion 9*b* in the originally intended direction is continued.

In this manner, proper oil films can be formed between the camshafts and the bearing portions. As a result, it is possible to suppress trouble or malfunctions such as an increase in the rotational resistance of each camshaft 9, locking of each camshaft 9 against rotation, etc., during changing of the compression ratio.

In this regard, the time from the start of rotation of the cam shafts 9 until the reciprocating rotation of the camshafts 9 begins to be carried out can be determined as follows. That is, a time point or a period of time is first experimentally determined in advance at which there takes place a shortage of oil films between the camshafts 9 and the bearing portions 18 after the start of rotation of the camshafts 9, and then an appropriate predetermined time can be set shorter than the period of time thus determined.

Here, noted that the frequency or the number of times of the reciprocating rotations of the camshafts 9 after the elapse of the predetermined time need not be limited to one, but may instead be a plurality of times. In this case, a determination as to whether the predetermined time as set in the above manner has elapsed corresponds to the execution of an oil film shortage estimating step in this embodiment. Also, performing the reciprocating rotation of the camshafts 9 corresponds to the execution of an oil film forming step in this embodiment.

In addition, in this embodiment, the camshafts 9 are caused to reciprocatingly rotate after the predetermined time has elapsed from the start of rotation of the camshafts 9, but instead it may be controlled such that the reciprocating rotation of the camshafts 9 is commenced when the camshafts 9 has rotated a predetermined angle of rotation from the start of rotation thereof. In this case, the predetermined angle of rotation can be set as follows. That is, an angle of rotation of the camshafts 9 is first experimentally determined in advance at which there takes place a shortage of oil films between the camshafts 9 and the bearing portions 18 after the start of rotation of the camshafts 9, and then an appropriate predetermined angle of rotation can be set shorter than the angle of rotation thus determined. In this case, a determination as to whether the camshafts 9 have rotated the predetermined angle of rotation as set in the above manner corresponds to the execution of the oil film shortage estimating step in this embodiment.

Moreover, in the case of the camshafts 9 being caused to reciprocatingly rotate during the rotation thereof, the rotational torque of the motor 12 may be monitored so that the reciprocating rotation of the camshafts 9 is started when the motor rotational torque exceed a predetermined value. Here, note that the above predetermined value is a torque value in the form of a threshold, based on which it can be estimated that an oil film shortage between the camshafts 9 and the bearing portions 18 has occurred when the motor rotational torque exceeds the predetermined value. In this case, a determination as to whether the motor rotational torque exceeds the predetermined value corresponds to the execution of the oil film shortage estimating step in this embodiment.

Further, the reciprocating rotation may be carried out at the start of rotation of the camshafts 9. By doing so, even in case where the camshafts 9 are driven to rotate from the state in which the thickness of the oil film is thin as at point A in FIGS. 3A through 3C, such as when the camshafts 9 are caused to rotate again after having been stopped for an extended period of time, an oil film can be formed again at the above-mentioned point A prior to the rotation of the camshafts 9, whereby it is possible to suppress the generation of defective rotation or lock phenomenon during the rotation of the camshafts 9. In this regard, the reciprocating rotation of the camshafts 9 may be carried out only when the stopped state of the camshafts 9 has continued longer than a predetermined time.

Furthermore, in cases where the time or the angle of rotation experimentally obtained as stated above is of a small value, the number of reciprocating rotations of the camshafts 9 to form oil films need not be limited to one per one rotation of the camshafts 9 upon changing the compression ratio. Therefore, the operation of the camshafts 9 may be controlled in such a manner that the reciprocating rotation of the camshafts 9 is performed at each predetermined time interval or at each predetermined angle of rotation during one rotation of the camshafts 9.

In this manner, the oil film forming device21 according to the present invention is achieved by controlling the motor 12 so as to drive the camshafts 9 to rotate reciprocatingly by means of the ECU 20.

[Embodiment 2]

Now, a second embodiment of the present invention will be described below. Herein, only those portions of this embodiment which are different from the above-mentioned first embodiment will be described, with the same portions in these embodiments being identified by the same reference symbols while omitting an explanation thereon.

In the above-mentioned first embodiment, there has been explained the case in which when the camshafts 9 are started to rotate or are being rotated so as to change the combustion ratio of the internal combustion engine 1, oil films are formed between the camshafts 9 and the bearing portions 18 by rotating the camshafts 9 in a reciprocating manner. However, in this second embodiment, reference will be made to the case where the reciprocating rotation of the camshafts 9 as explained in the first embodiment is performed at the time when the camshafts 9 are stopped, i.e., at times other than the time of changing the compression ratio, so as to prevent a shortage of oil films between the camshafts 9 and the bearing portions 18.

In the internal combustion engine whose compression ratio is changed by rotating the camshafts 9 thereby to move the cylinder block 3 and the crankcase 4 relative to each other, as stated above, loads due to the self weight of the cylinder block 3 and the combustion or firing pressure in the cylinders 2 are constantly applied to between the camshafts 9 and the bearing portions 18 even when the camshafts 9 are stopped, i.e., at times other than when the compression ratio is changed. Accordingly, even during the time when the camshafts 9 have been stopped for an extended period of time, the oil films between the camshafts 9 and the bearing portions 18 decrease, thus giving rise to a shortage of oil films in some cases.

In view of such a circumstance, in this second embodiment, an oil film shortage between the camshafts 9 and the bearing portions 18 can be prevented by performing reciprocating rotation of the camshafts 9 at regular intervals during the stopped time of the camshafts 9, whereby the rotation of the camshafts 9 at the time of changing the compression ratio can be made in a quick and smooth manner.

Figure 4:
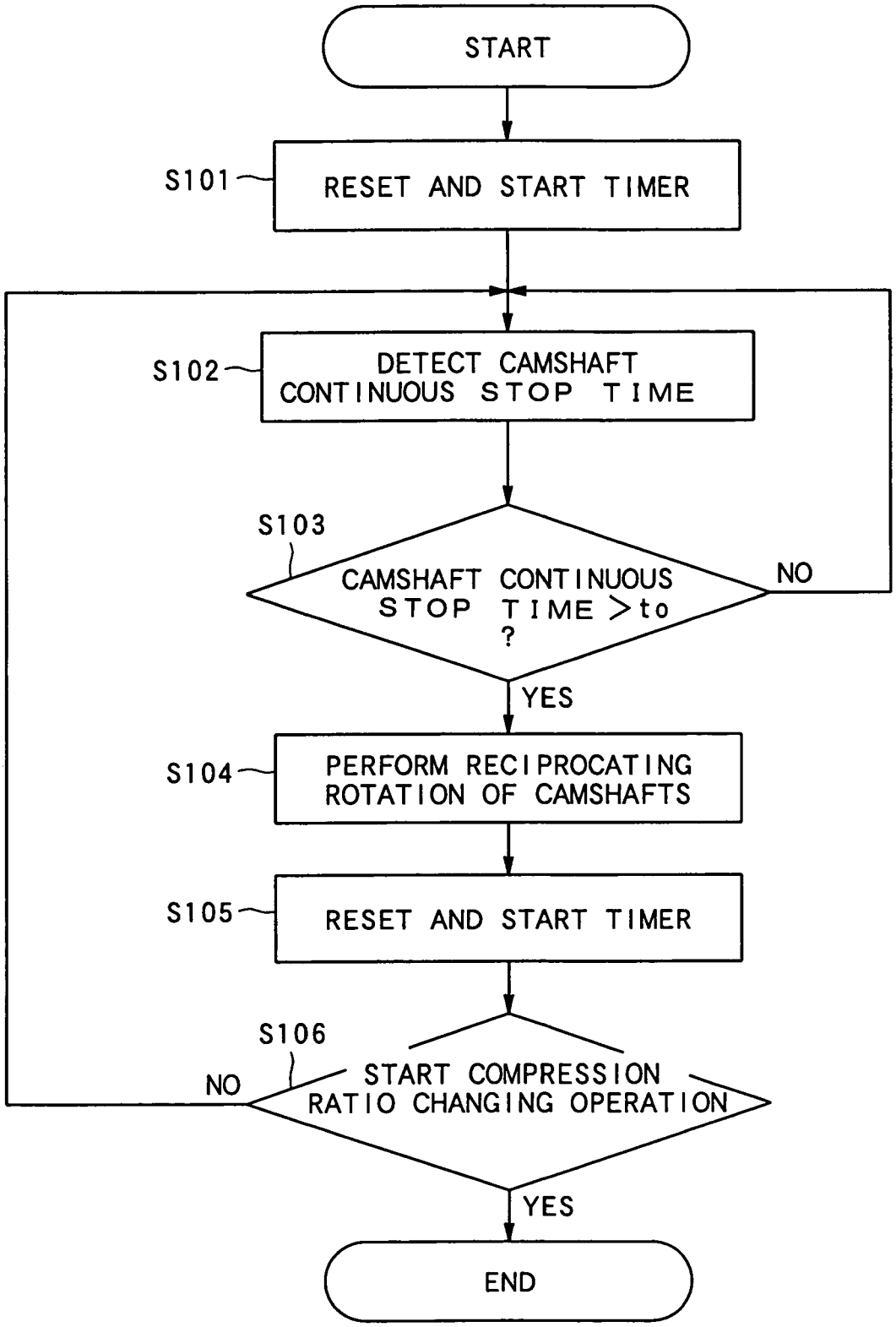
FIG. 4 is a flow chart showing an oil film forming routine according to a second embodiment of the present invention.

FIG. 4 is a flow chart showing an oil film forming routine in this second embodiment. This routine is constituted by a program stored in the ROM inside the ECU 20, and it is a routine which is processed by an interrupt with the completion of rotating operation of the camshafts 9 for changing the compression ratio being used as a trigger.

When this routine is executed by ECU 20, first in step S101, a timer for measuring the continuously stopped time of the camshafts 9 is started after being reset once.

Then, in step S102, the continuously stopped time of the camshafts 9 (hereinafter referred to as "camshaft continuous stop time") is detected. Specifically, this is detected by the CPU reading the value of the timer that has been started in step S101.

Thereafter, in step S103, it is determined whether the camshaft continuous stop time detected in step S102 is longer than a predetermined value $t_0$ which was set beforehand. Here, note that $t_0$ is a time in the form of a threshold, based on which a determination is made that an occurrence of an oil film shortage might take place between the camshafts 9 and the bearing portions 18 when the camshafts 9 have been stopped for a period of time longer than $t_0$. Therefore, when the camshaft continuous stop time is less than or equal to the predetermined value $t_0$, it is considered that there are sufficient oil films formed between the camshafts 9 and the bearing portions 18, and hence a return is performed to step S102 where the camshaft continuous stop time is detected again and this operation is repeated until a determination is made in step S103 that the camshaft continuous stop time detected in step S102 is longer than the predetermined value $t_0$.

On the other hand, when it is determined in step S103 that the camshaft continuous stop time is longer than the predetermined value $t_0$, the control flow advances to step S104 where the reciprocating rotation of the camshafts 9 is carried out. With the reciprocating rotation of the camshafts 9, oil films are formed in those parts in which an oil film shortage occurs or might occur. In this regard, note that an angle of rotation capable of eliminating the problem of oil film shortage by means of the reciprocating rotation of the camshafts 9 is experimentally obtained in advance, and the angle through which the camshafts 9 are driven to reciprocatingly rotate at this time may be set greater than the angle of rotation thus obtained. For example, such an angle of rotation may be set to 180 degrees. In addition, the number of times of the reciprocating rotations need not be limited to one, but two times of reciprocating motions of 180 degrees may be carried out. When the processing in step S104 is completed, the control flow goes to step S105.

In step S105, the timer is restarted after having been once reset, in order to start the measurement of the following camshaft continuous stop time. When the processing in step S105 is completed, the control flow proceeds to step S106.

In step S106, it is determined whether a compression ratio changing operation has been started. That is, it is determined whether the camshafts 9 have been driven to rotate by a command from the ECU 20 to change the compression ratio in the cylinders 2 of the internal combustion engine 1. In this regard, it should be noted that the rotation of the camshafts 9 referred to herein does not of course include the reciprocating rotation of the camshafts 9 in step S104.

When it is determined in step S106 that the compression ratio changing operation has not been started, a return is performed to step S102 and this routine is continued, whereas when it is determined in step S106 that the compression ratio changing operation has been started, this routine is completed.

As described above, in this second embodiment, the continuous stop time of the camshafts 9 is detected when the camshafts 9 is stopped in their rotation, so that when the camshaft continuous stop time thus detected is longer than the predetermined value, the reciprocating rotation of the camshafts 9 is executed. That is, oil films are formed between the camshafts 9 and the bearing portions 18 at every predetermined time interval during the stop of the camshafts 9. Accordingly, it is possible to suppress the occurrence of an oil film shortage between the camshafts 9 and the bearing portions 18 due to the self weight of the cylinder block 3 or the combustion pressure in the cylinders 2. As a result, when the camshafts 9 are started to rotate for changing the compression ratio, it is possible to rotate the camshafts 9 in a quick and smooth manner.

Here, note that in the above-mentioned oil film forming routine, it may be determined in a step between the step S103 and the step S104 whether the internal combustion engine 1 is in deceleration, and when determined not in deceleration, the control flow jumps to step S106 as it is without performing the formation of oil films by the reciprocating rotation of the camshafts 9, whereas when determined in deceleration, the control flow advances to step S104. That is, the reciprocating rotation of the camshafts 9 for forming oil films may be performed only during decelerating operation of the engine. By doing so, it is possible to prevent the trouble that the compression ratio of the internal combustion engine 1 is changed due to the reciprocating rotation of the camshafts 9 in engine operating states other than during the decelerating operation state, thereby adversely influencing the operating condition of the engine. Here, note that the term "during the decelerating operation state" means that the internal combustion engine 1 is in a fuel cut-off state or in an ignition cut-off state. In actuality, such a state is determined by reading out control signals issued from the ECU 20 to fuel injection valves or spark plugs.

Moreover, the above-mentioned processing in step S103 of the oil film forming routine corresponds to an oil film shortage estimating step in this second embodiment, and the processing in step S104 corresponds to an oil film forming step in this embodiment.

[Embodiment 3]

Next, a third embodiment of the present invention will be described below. Herein, only those portions of this embodiment which are different from the above-mentioned first embodiment will be described, with the same portions in these embodiments being identified by the same reference symbols while omitting an explanation thereon.

In the above-mentioned first and second embodiments, there has been explained the case in which oil films are formed between the camshafts 9 and the bearing portions 18 by rotating the camshafts 9 in a reciprocating manner, but in this third embodiment, reference is made to the case where spaces or clearances between the camshafts 9 and the corresponding bearing portions 18 are formed into tapered shapes or configurations, so that oil films are formed between the camshafts 9 and the corresponding bearing portions 18, which are formed into tapered configurations, by axially moving the camshafts 9 back and forth relative to the corresponding bearing portions 18.

Figure 5A:
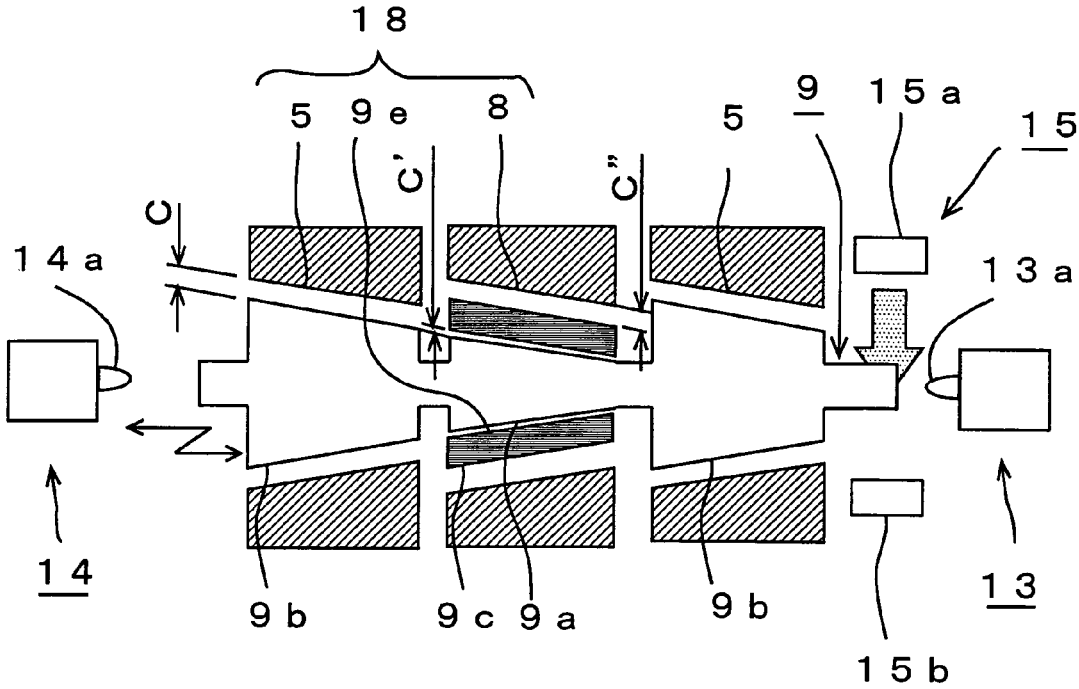
FIG. 5A is a cross sectional view showing the schematic construction in the vicinity of a camshaft according to a third embodiment of the present invention.

FIG. 5A is a cross sectional view that shows the construction in the vicinity of a camshaft 9 in this embodiment. Here, the outer surfaces or shapes of the cam portions 9*b* and the shaft portion 9*a* of the camshaft 9 as well as the outer shapes of the movable bearing portions 9*c* are all formed into tapered configurations, and the cam receiving holes 5, the bearing receiving holes 8, and the shaft receiving holes 9*e* in the movable bearing portions 9 are also formed into tapered configurations. A shaft push-out piezoelectric actuator 13 is arranged at the right side of each camshaft 9 in this figure, and a shaft position returning piezoelectric actuator 14 is arranged at the left side of each camshaft 9 in this figure. Here, note that in FIG. 1, each camshaft 9 includes five cam portions 9*b* and four movable bearing portions 9*c*, but in FIG. 5A, description will be made assuming that each camshaft 9 includes two cam portions 9*b* and one movable bearing portion 9*c* for the sake of simplification.

Now, with the above construction, when oil films are formed between the camshaft 9 and the bearing portions 18, which are all formed into tapered configurations, the shaft push-out piezoelectric actuator 13 acts to axially push out the camshaft 9, whereby the camshaft 9 is moved to the left in FIG. 5A, thereby increasing gaps or clearances C between the cam portions 9*b* and the cam receiving holes 5, a gap or clearance C' between the shaft portion 9*a* and the shaft receiving hole 9*e*, and a gap or clearance C" between the movable bearing portion 9*c* and the shaft receiving hole 8. Thereafter, the camshaft 9 is caused to move to the right in FIG. 5A by means of the shaft position returning piezoelectric actuator 14, so that it is returned to its original position.

With this operation, it is possible to suppress the occurrence of oil film shortage in the gaps or clearances between the camshaft 9 and the bearing portions 18. This is because the gaps or clearances C, C', C" between the camshaft 9 and the bearing portions 18 are first temporarily increased to permit lubricating oil around these gaps or clearances between the camshaft 9 and the bearing portions 18 to move into between the camshaft 9 and the bearing portions 18, and then these gaps or clearances are decreased again in accordance with the returning movement of the camshaft 9, thereby forcing the thus moved lubricating oil to spread between the camshaft 9 and the bearing portions 18.

In this manner, proper oil films can be formed between the camshaft 9 and the bearing portions 18. Here, in this embodiment, the shaft push-out piezoelectric actuator 13 and the shaft position returning piezoelectric actuator 14 are used as an actuator unit for driving the camshaft 9 to move axially, as stated above. This is achieved by application of a so-called "core striking mechanism", which serves to momentarily impress a voltage on a piezo-electric element to accelerate the heads 13*a*, 14*a* each having a predetermined mass thereby to provide them with inertia, so that the heads are then forced to strike against the camshaft 9 thereby to move the camshaft 9.

In this third embodiment, since this mechanism is adopted as the actuator unit for moving the camshaft 9, even if the camshaft 9 is subjected to loads such as the self weight of the cylinder block 3, the combustion or firing pressure in the cylinders 2, etc., it can be moved against a friction force resulting from the loads. In addition, the amount of movement of the camshaft 9 can be finely adjusted by providing the camshaft 9 with an impact in a plurality of times. Moreover, since the camshaft 9 is moved by forcing the head 13*a*, 14*a* each having the predetermined mass to strike or collide against the camshaft 9, the acceleration of the camshaft 9 during its movement can be made large. In this embodiment, under the action of the self weight of the cylinder block 3 and the combustion or firing pressure in the cylinders 2, a load is applied to between the cam portions 9*b* and the cam receiving holes 5 so as to reduce the gaps or clearances C formed therebetween. Accordingly, when the camshaft 9 is moving axially, the gaps or clearances C between the cam portion 9*a* and the cam receiving holes 5, etc., can not be temporarily increased unless the camshaft 9 is moving at an acceleration at least greater than the acceleration of movement of the cylinder block 3 or the like resulting from the above load. From such a point of view, it is effective to adopt the so-called "core striking mechanism" in this embodiment.

Figure 5B:
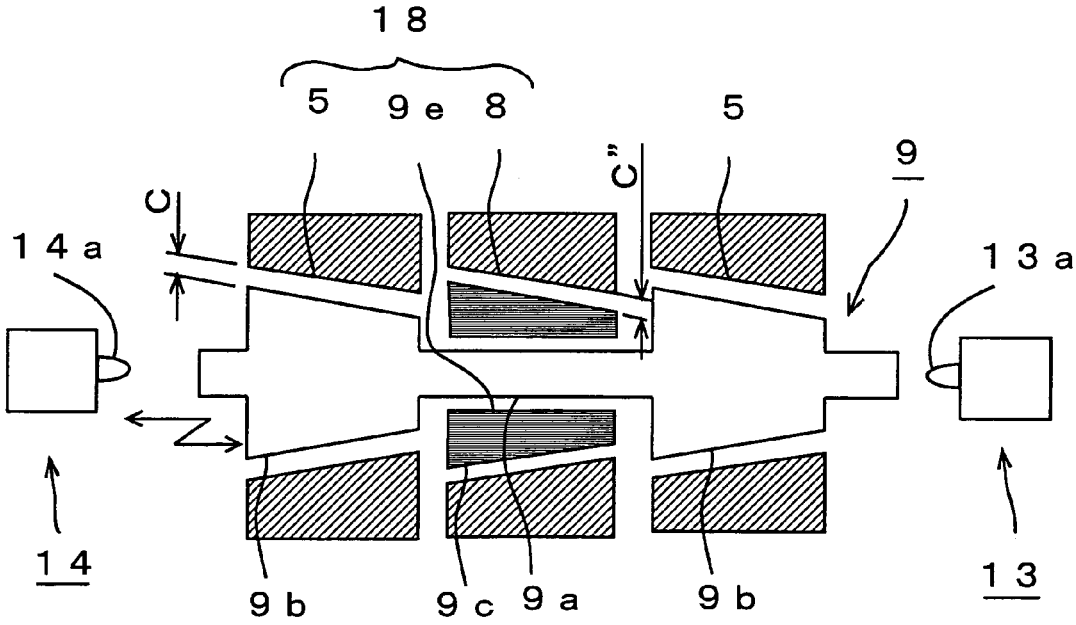
FIG. 5B is a cross sectional view showing another example of the schematic construction in the vicinity of the camshaft according to the third embodiment.

Although in this third embodiment, the outer surfaces or shapes of the cam portions 9*b* and the shaft portion 9*a* of the camshaft 9 as well as the outer surfaces or shapes of the movable bearing portions 9*c* are all formed into tapered configurations, and the inner surfaces or shapes of the cam receiving holes 5, the shaft receiving hole 9*e* and the bearing receiving hole 8 are also formed into tapered configurations, all of these need not of course be formed into tapered configurations. For example, in an illustration shown in FIG. 5B, the outer surfaces or shapes of the cam portions 9*b* and the movable bearing portion 9*c* of the camshaft 9 are formed into tapered configurations, and the cam receiving holes 5 and the bearing receiving hole 8 are also formed into tapered configurations, but the outer surface or shape of the shaft portion 9*a* and the inner surface or shape of the shaft receiving hole 9*e* are not formed into tapered configurations. Thus, for example, in case where an oil film shortage between the outer surface of the shaft portion 9*a* and the inner surface of the shaft receiving hole 9*e* is not much problem, these parts need not take tapered configurations.

Next, reference will be made to the oil film forming control in this third embodiment. In this embodiment, the motor 12 is energized to change the compression ratio of the internal combustion engine 1, so that the camshaft 9 is driven to rotate, thereby moving the cylinder block 3 relative to the crankcase 4. Additionally, the rotational torque of the motor 12 is monitored during rotation of the camshaft 9. When the rotational torque becomes equal to or greater than a predetermined value, the camshaft 9 is driven to axially move back and forth, so that oil films are formed between the camshaft 9 and the bearing portions 18. With such control, it is possible to prevent a shortage of oil films from occurring in the course of rotation of the camshaft 9, thus avoiding resultant locking of the camshaft 9.

Figure 6:
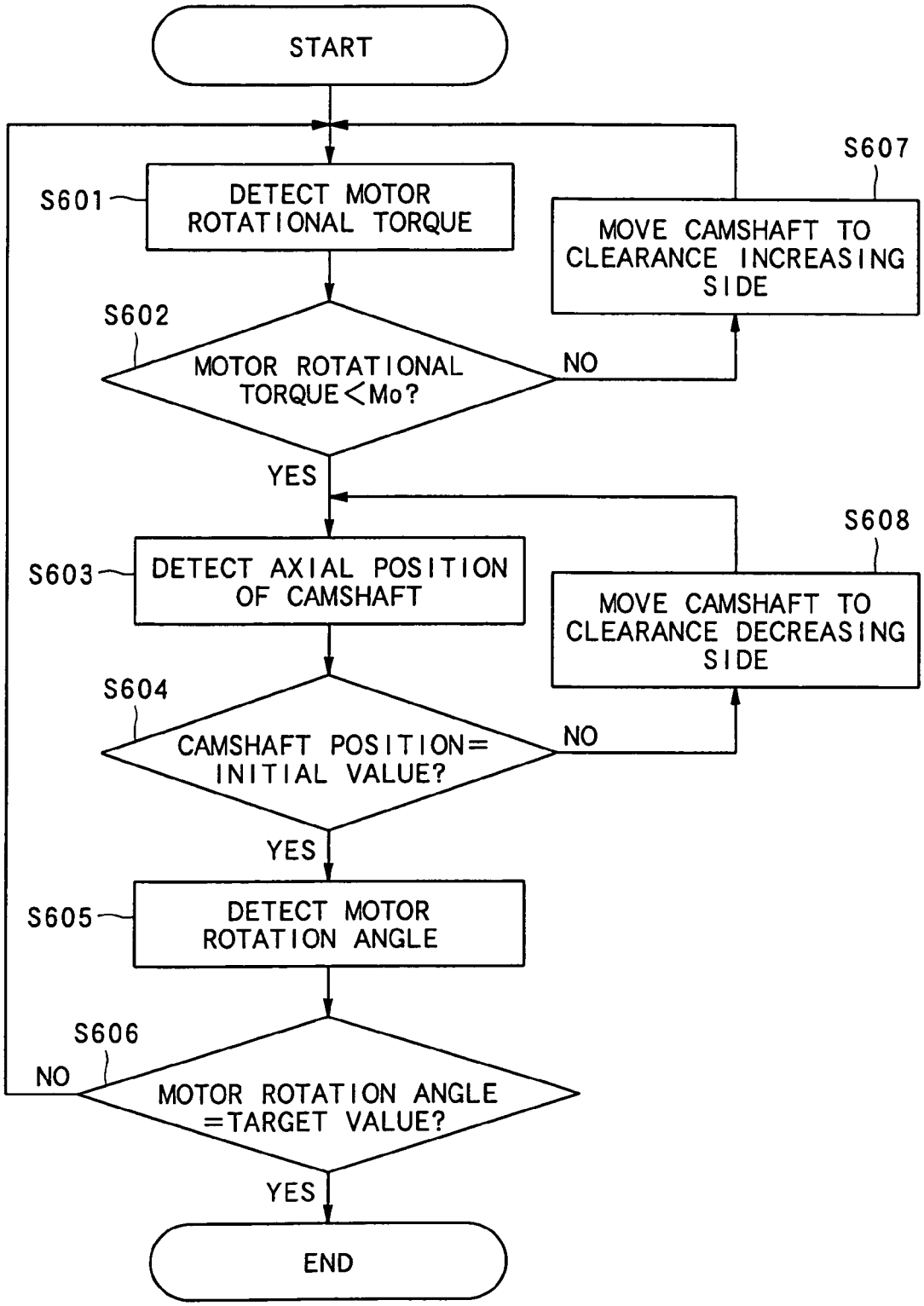
FIG. 6 is a flow chart showing an oil film forming routine according to the third embodiment of the present invention.

FIG. 6 is a flow chart showing an oil film forming routine in this third embodiment. This routine is constituted by a program stored in the ROM inside the ECU 20, and it is executed by ECU 20 when the motor 12 begins to be energized so as to change the compression ratio of the internal combustion engine. When this routine is executed, first in step S601. the rotational torque of the motor 12 is detected. Specifically, the motor rotational torque is estimated by detecting the value of current supplied to the motor 12.

In step S602, it is determined whether the motor rotational torque detected in step S601 is smaller than a predetermined value $M_0$. Here, note that $M_0$ is a torque value based on which the probability of an oil film shortage is determined, i.e., when the motor rotational torque is equal to or greater than $M_0$, it is determined that the probability that an oil film shortage takes place between the camshaft 9 and the bearing portions 18 is high, and which is a value experimentally obtained beforehand.

In step S602, when the motor rotational torque is more than or equal to $M_0$, it is determined that an oil film shortage might take place between the camshaft 9 and the bearing portions 18. Accordingly, the control flow advances to step S607 where the camshaft 9 is driven to move in a direction to increase the gaps or clearances C, C', C" between the camshaft 9 and the bearing portions 18. Specifically, by momentarily impressing a voltage to the shaft push-out piezoelectric actuator 13, an impact is applied to the camshaft 9. When the processing in step S607 is completed, a return to step S601 is performed.

Then, in step S601, the motor rotational torque is detected again, and in step S602, it is determined whether the motor rotational torque is smaller than $M_0$. A series of the above processes are repeated until a determination is made in step S602 that the motor rotational torque is smaller than $M_0$, and the control flow advances to step S603 when it is determined in step S602 that the motor rotational torque is smaller than $M_0$.

In step S603, the axial position of the camshaft 9 is detected. Specifically, a light emitting element 15*a* and a light receiving or detecting element 15*b* are arranged at one end of the camshaft 9. A transparent type photoelectric sensor 15, which is constructed in such a manner that a part of light emitted from the light emitting element 15*a* is interrupted by the camshaft 9, may be installed so that the axial position of the camshaft 9 can be detected from an output signal of the light receiving element 15*b*. When the processing in step S603 is completed, the control flow goes to step S604.

In step S604, it is determined whether the axial position of the camshaft 9 is an initial position. Here, when it is determined that the position of the camshaft 9 is not an initial position, it is considered that the gaps or clearances C, C', C" between the camshaft 9 and the bearing portions 18 remain increased, and hence the control flow advances to step S608 where the camshaft 9 is driven to move in a direction to decrease the gaps or clearances C, C', C" between the camshaft 9 and the bearing portions 18. Specifically, by impressing a voltage on the piezo-electric element of the shaft position returning piezoelectric actuator 14, an impact is applied to the camshaft 9 thereby to move it. Then, a return is performed to step S603 where the position of the camshaft 9 is detected again. Thereafter, in step S604, it is determined whether the position of the camshaft 9 has been returned to the initial position again.

In step S604, this processing is repeated until a determination is made that the camshaft 9 has been returned to the initial position. When it is determined in step S604 that the camshafts 9 has been returned to the initial position, the control flow advances to step S605 where the angle of rotation of the motor 12 is detected. Specifically, provision is made for an unillustrated encoder that generates an electrical pulse each time the motor 12 rotates a predetermined angle, so that the angle of rotation of the motor 12 is estimated based on the number of electrical pulses output from this encoder. Here, note that the method of detecting the angle of rotation of the motor 12 is not limited to this, but such detection will be carried out such as by reading the number of marks, which are in advance provided on the gear 10 at each predetermined angle, by means of a photoelectric sensor.

Subsequently, in step S606, it is determined whether the angle of rotation of the motor 12 becomes a target value, i.e., whether the cylinder block 3 has moved to a position required to obtain a target value of the compression ratio. Here, when it is determined that the angle of rotation of the motor 12 has reached the target value, this routine is once completed, whereas when otherwise, a return is performed to step S601 and the processing of this routine is executed again.

As described above, in this third embodiment, the rotational torque of the motor 12 is detected in the course of control of changing the compression ratio, and when the rotational torque of the motor 12 thus detected becomes greater than or equal to the predetermined value, it is decided that the probability of occurrence of an oil film shortage between the camshaft 9 and the bearing portions 18 is high, and the camshaft 9 is caused to axially move back and forth, thereby forming oil films between the camshaft 9 and the bearing portions 18. As a result, it is possible to suppress an extreme increase in the rotational resistance of the camshaft 9 and hence a resultant increase in the power consumption of the motor 12 as well as locking of the camshaft 9 due to the shortage of oil films in the course of control of changing the compression ratio.

Further, in this embodiment, the rotational torque of the motor 12 is detected, and the back and forth movement of the camshaft 9 is not carried out until the rotational torque of the motor 12 actually becomes equal to or greater than the predetermined value. Accordingly, it is possible to avoid or eliminate wasteful or unnecessary operation of axially moving the camshaft 9 even in the case where there is no fear that an oil film shortage might take place between the camshaft 9 and the bearing portions 18. Consequently, electric power consumption can be reduced, thus making it possible to improve fuel mileage.

Incidentally, in this embodiment, description has been made to the control in which when it is determined in step S602 that the rotational torque of the motor 12 is greater than or equal to the predetermined value $M_0$, the back and forth movement of the camshaft 9 is carried out without stopping the rotation of the motor 12, but control may be such that when the rotational torque of the motor 12 becomes greater than or equal to predetermined value $M_0$, the motor 12 is once stopped, and the back and forth movement of the camshaft 9 is performed, after which the rotation of the motor 12 is resumed. In addition, it may be controlled such that when the rotational torque of the motor 12 is decreased below the predetermined value $M_0$ owing to the movement of the camshaft 9 in the direction to increase the gaps or clearances C, C', C" between the camshaft 9 and the bearing portions 18, the motor 12 in that state is first driven to rotate up to the target angle of rotation, and then the position of the camshaft 9 is returned to the initial position after the compression ratio has been changed.

Furthermore, it is to be noted that the above processing in step S602 of the oil film forming routine corresponds to an oil film shortage estimating step in this third embodiment, and the processing in step S607 corresponds to an oil film forming step in this third embodiment.

[Embodiment 4]

Now, a fourth embodiment of the present invention will be described below. Herein, only those portions of this embodiment which are different from the above-mentioned third embodiment will be described, with the same portions in these embodiments being identified by the same reference symbols while omitting an explanation thereon.

Figure 7:
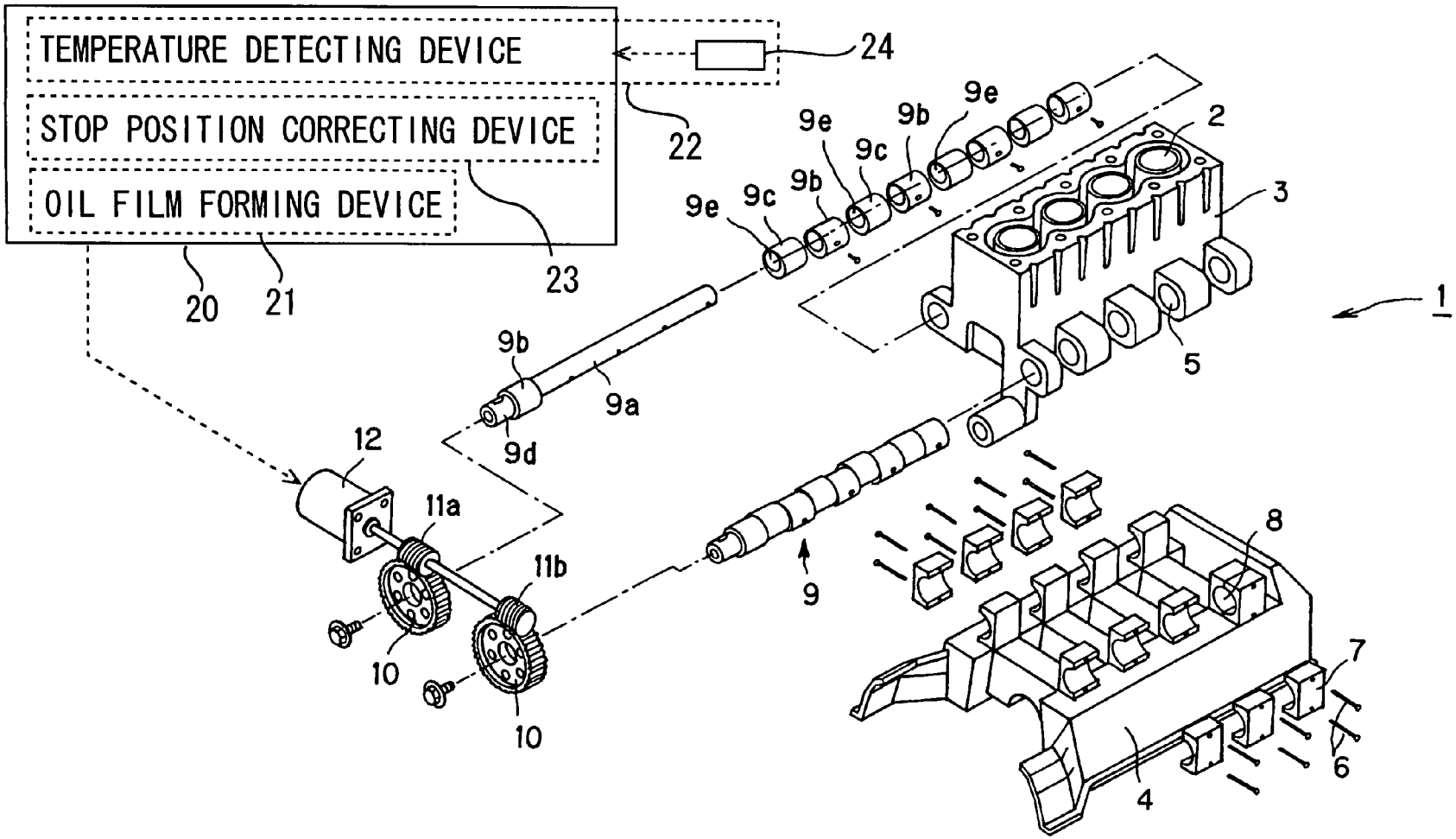
FIG. 7 is an exploded perspective view showing the schematic construction of an internal combustion engine according to a fourth embodiment of the present invention.

FIG. 7 shows the construction of a variable compression ratio type internal combustion engine according to this fourth embodiment of the present invention. The ECU 20 in FIG. 7 includes a temperature detecting device 22 and a stop position correcting device 23 that are constituted by a program stored in the ROM of the ECU 20. Moreover, provision is made for a temperature sensor 24 that is electrically connected to the ECU 20 for detecting the temperature of water circulating through the internal combustion engine 1.

This fourth embodiment is similar to the above-mentioned third embodiment in that the cam portions 9*b*, the cam receiving holes 5 and the like are formed into tapered configurations, and oil films are formed on the tapered portions in accordance with the axial back and forth movements of the camshaft 9. Further, in this fourth embodiment, a temperature change in the vicinity of the camshaft 9 is detected so that the camshaft 9 is driven to move axially in accordance with the detected temperature in the vicinity of the camshaft 9 thereby to correct the stop position of the camshaft 9. As a consequence, the gaps or clearances C, C', C" between the camshaft 9 and the bearing portions 18 can be prevented from being varied by the temperature change in the vicinity of the camshaft 9.

In this forth embodiment, an increase or decrease in the gaps or clearances C, C', C" between the camshaft 9 and the bearing portions 18 due to the thermal deformation of component members such as the camshaft 9, etc., is estimated in advance, based on which a map representing the relation between the temperature in the vicinity of the camshaft 9 and the proper axial position of the camshaft 9 is prepared in advance. Thus, by moving the camshaft 9 to a position read out from the map, the gaps or clearances C, C', C" between the camshaft 9 and the bearing portions 18 are controlled to be suitable for the formation of oil films regardless of the temperature in the vicinity of the camshaft 9.

Figure 8:
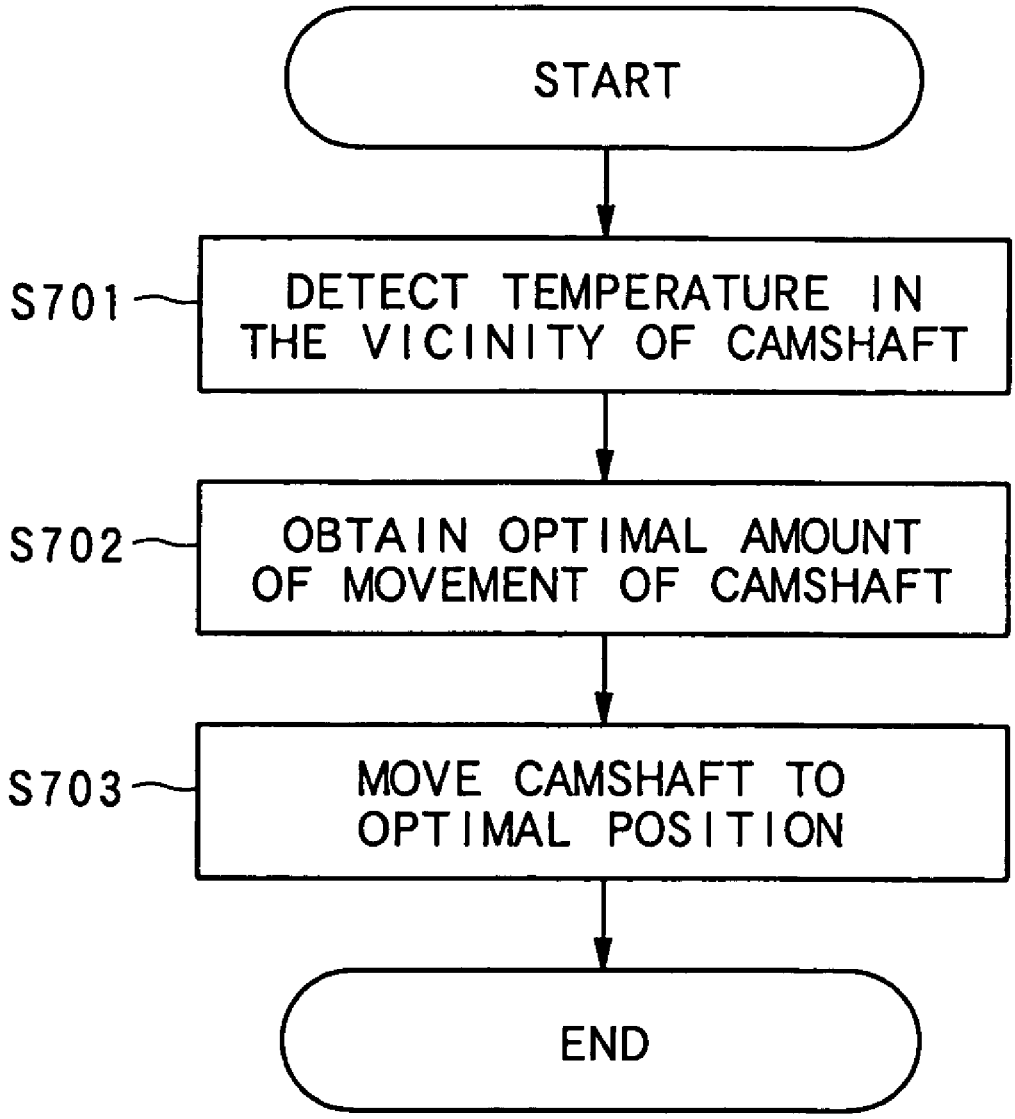
FIG. 8 is a flow chart showing a thermal deformation correcting routine according to the fourth embodiment of the present invention.

A thermal deformation correcting routine in this embodiment will be described below while using FIG. 8. This routine is executed by ECU 20 at each predetermined time interval during the operation of the internal combustion engine 1. That is, in this embodiment, when the compression ratio is changed, an increase in the rotational resistance of the camshaft 9 is prevented by the same control as the oil film forming control explained in the above-mentioned third embodiment, and in addition to such control, thermal deformation correction control is always performed also at times other than the time of changing the compression ratio.

When the thermal deformation correction routine according to this embodiment is executed, first in step S701, the temperature in the vicinity of the camshaft 9 is detected. Specifically, the temperature of water circulating through the internal combustion engine 1 is detected by the temperature sensor 24, so that the temperature in the vicinity of the camshaft 9 is estimated from the water temperature thus detected. Here, note that the method of detecting the temperature in the vicinity of the camshaft 9 is not limited to this. For example, it may be estimated from the temperature of the lubricating oil, or it may be detected directly from the temperature of the camshaft 9. The temperature detecting device22 in this embodiment is constituted by the temperature sensor 24 and the processing in step S701 of the thermal deformation correcting routine.

Then, in step S702, a proper amount of movement of the camshaft 9 is obtained. Specifically, data for the proper amount of movement of the camshaft 9 corresponding to the temperature in the vicinity of the camshaft 9 detected in step S701 is read out from the temperature correction map that represents the relation between the temperature in the vicinity of the camshaft 9 and the axial position of the camshaft 9 for maintaining the gaps or clearances C, C', C" between the camshaft 9 and the bearing portions 18 at values suitable for the formation of oil films at that temperature.

Thereafter, in step S703, the camshaft 9 is driven to move by the proper amount of movement obtained in step S702. Here, note that this movement is carried out by applying impacts to the camshaft 9 by means of the shaft push-out piezoelectric actuator 13 and the shaft position returning piezoelectric actuator 14 as explained in the third embodiment.

As described above, in this embodiment, the temperature in the vicinity of the camshaft 9 is detected, and the camshaft 9 is driven to axially move in accordance with the temperature thus detected, whereby the gaps or clearances C, C', C" between the camshaft 9 and the bearing portions 18 are maintained at optimal values or therearound, thus suppressing changes in the gaps or clearances C, C', C" between the camshaft 9 and the bearing portions 18 owing to the temperature in the vicinity of the camshaft 9. As a result, even at the time when the compression ratio is not changed, it is possible to suppress reduction in the thickness of the oil films between the camshaft 9 and the bearing portions 18 and resultant locking of the camshaft 9 due to a change in the temperature in the vicinity of the camshaft 9, thereby making it possible to perform rotation of the camshaft 9 in a quicker and smoother manner at the time when the compression ratio is actually changed.

The stop position correcting device23 in this embodiment is constituted by the ECU 20 with a ROM having the above-mentioned thermal deformation correcting routine stored therein, the shaft push-out piezoelectric actuator 13, and the shaft position returning piezoelectric actuator 14.

[Embodiment 5]

Now, a fifth embodiment of the present invention will be described below. Herein, only those portions of this embodiment which are different from the above-mentioned third embodiment will be described, with the same portions in these embodiments being identified by the same reference symbols while omitting an explanation thereon.

In the fifth embodiment, reference is made to the case where the cam portions 9*b*, the cam receiving holes 5 and the like are not of tapered configurations but of cylindrical or columnar configurations, and oil films are formed between the camshaft 9 and the bearing portions 18 by driving the camshaft 9 to reciprocate in a direction substantially perpendicular to the axis thereof.

Figure 9:
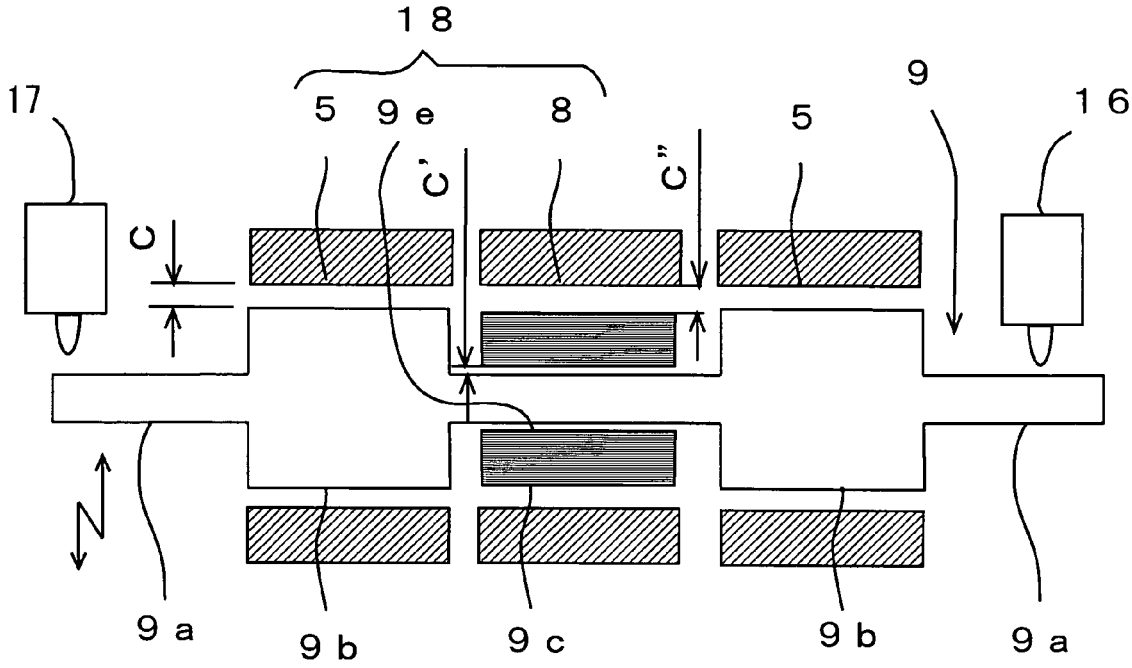
FIG. 9 is a cross sectional view showing the schematic construction in the vicinity of a camshaft according to a fifth embodiment of the present invention.

FIG. 9 is a cross sectional view that shows the schematic construction in the vicinity of the camshaft 9 in this fifth embodiment. In this embodiment, shaft moving piezoelectric actuators 16, 17 are arranged in a direction substantially perpendicular to the axial direction of the camshaft 9. As shown in FIG. 9, the outer surfaces or shapes of the shaft portion 9*a*, the cam portions 9*b* and the movable bearing portion 9*c* are all of cylindrical or columnar configurations, and the inner surfaces or shapes of the shaft receiving hole 9*e*, the cam receiving holes 5 and the bearing receiving hole 8 are also all of cylindrical or columnar configurations. In addition, the shaft portion 9*a* is extended longer at the opposite ends of the camshaft 9 as compared with the one in the third and fourth embodiments.

Here, when oil films are formed between the camshaft 9 and the bearing portions 18, impacts are applied to the opposite ends of the shaft portion 9*a* extended at the opposite ends of the camshaft 9 by the shaft moving piezoelectric actuators 16, 17. By doing so, the camshaft 9 is driven to momentarily reciprocate in the vertical direction in FIG. 9, thereby temporarily increasing or expanding the gaps or clearances C, C', C" between the camshaft 9 and the bearing portions 18. As a result, lubricating oil around the gaps or clearances C, C', C" moves into the parts where the gaps or clearances have become large. When the camshaft 9 returns to its former or original position, the gaps or clearances, having been temporarily expanded, are contracted to force the moved lubricating oil to spread between the camshaft 9 and the bearing portions 18. Consequently, oil films are formed between the camshaft 9 and the bearing portions 18.

As described above, in this fifth embodiment, the cam portion 9*a* and the cam receiving holes 5 of the camshafts 9, etc., are formed into cylindrical or columnar configurations, and impacts are applied, from a direction of substantially perpendicular to the axial direction of the camshaft 9, to the opposite ends of the shaft portion 9*a* of extended at the opposite ends of the camshaft 9, whereby oil films can be formed between the camshaft 9 and the bearing portions 18. Therefore, it is possible to suppress a shortage of oil films on the camshaft 9 with a simple structure without forming the cam portions 9*b*, the cam receiving holes 5 and the like into tapered configurations.

Regarding the time of forming oil films in this fifth embodiment, the forming of oil films may be carried out at prescribed timing during the rotation of the camshaft 9 for changing of the compression ratio, or the rotational torque of the motor 12 is detected and the formation of oil films may be carried out when the torque thus detected becomes equal to or greater than a predetermined value. Moreover, the formation of oil films may be performed at each predetermined time interval while the camshaft 9 is stopped, so that a shortage of oil films between the camshaft 9 and the bearing portions 18 can be prevented during the stop of the camshaft 9.

Here, note that the oil film forming operation in this fifth embodiment is momentary and does not accompany any change in the position of the cylinder block 3 relative to the crankcase 4. Therefore, the time of performing such an oil film forming operation need not be particularly limited to during deceleration.

In addition, in this fifth embodiment, impacts are applied at the same time to the opposite ends of the shaft portion 9*a* extended at the opposite sides of the camshafts 9 by the shaft moving piezoelectric actuators 16, 17. However, control may be performed in such a manner that by impressing voltage on the piezo-electric elements of the shaft moving piezoelectric actuators 16, 17 with an appropriate time difference, impacts are applied, with the time difference, to the opposite ends of the shaft portion 9*a* extended at the opposite sides of the camshaft 9, so that the camshaft 9 can be driven to reciprocate in a tilted or inclined manner. Moreover, unillustrated additional shaft moving piezoelectric actuators may be separately arranged at opposite sides of the shaft moving piezoelectric actuators 16, 17, respectively, with the shaft portion 9*a* interposed therebetween, so that impacts are applied to the opposite ends of the shaft portion 9*a* from above and below in FIG. 9.

Moreover, the above-mentioned shaft moving piezoelectric actuators need not be arranged at the opposite ends of the camshaft 9, but they may of course be arranged between the cam portions 9*b* and the movable bearing portion 9*c* of the camshaft 9. In short, the number and arrangement of the shaft moving piezoelectric actuators may be properly changed in accordance with the length of the camshaft 9*c*, the number of the cam portions 9*b* and the movable bearing portions 9*c*.

Here, note that internal combustion engines to which the present invention is applied are not limited to such ones as described in FIGS. 1 and 2, but can be widely applied to internal combustion engines in which each camshaft has a shaft portion rotatably supported by bearing portions and a cam portion fixedly secured to the shaft portion, and in which the compression ratio can be changed by rotating each camshaft thereby to move a cylinder block and a crankcase relative to each other.

While the invention has been described in terms of preferred embodiments, those skilled in the art will recognize that the invention can be practiced with modifications within the spirit and scope of the appended claims.

What is claimed is:

1. A variable compression ratio mechanism in which a cylinder block and a crankcase of an internal combustion engine are coupled with each other for relative movement, and one or more camshafts are rotatably mounted on bearing portions at which said cylinder block and said crankcase are coupled with each other, so that said cylinder block and said crankcase are caused to move relative to each other in accordance with a rotation of said camshafts thereby to change a compression ratio of said internal combustion engine, said mechanism comprising:

a rotation device driving said camshafts to rotate; wherein:

said cylinder block has one or more cylinders;

a pair of said camshafts are disposed between said cylinder block and said crankcase on opposite sides of said cylinders in a parallel relation;

each of said camshafts has a shaft portion, a cam portion fixedly secured to said shaft portion, and a movable bearing portion rotatably mounted on said shaft portion;

said cam portion of each camshaft is received in a cam receiving hole formed in one of said cylinder block and said crankcase;

said shaft portion of each camshaft, on which said movable bearing portion is rotatably mounted, is received in a shaft receiving hole formed in said movable bearing portion;

said movable bearing portion of each camshaft is received in a bearing receiving hole formed in the other of said cylinder block and said crankcase; and said rotation device drives said camshafts to rotate whereby said cylinder block is caused to move relative to said crankcase in an axial direction of said cylinders thereby to change the compression ratio in said cylinders; and an oil film forming device that forms oil films between said camshafts and the bearing portions rotatably supporting said camshafts.

2. A variable compression ratio mechanism in which a cylinder block and a crankcase of an internal combustion engine are coupled with each other for relative movement, and one or more camshafts are rotatably mounted on bearing portions at which said cylinder block and said crankcase are coupled with each other, so that said cylinder block and said crankcase are caused to move relative to each other in accordance with a rotation of said camshafts thereby to change a compression ratio of said internal combustion engine, said mechanism comprising:

an oil film forming device that forms oil films between said camshafts and the bearing portions rotatably supporting said camshafts, wherein said oil film forming device forms oil films between said camshafts and said bearing portions therefor, respectively, when said camshafts begin to rotate so as to change the compression ratio of said internal combustion engine.

3. A variable compression ratio mechanism in which a cylinder block and a crankcase of an internal combustion engine are coupled with each other for relative movement, and one or more camshafts are rotatably mounted on bearing portions at which said cylinder block and said crankcase are coupled with each other, so that said cylinder block and said crankcase are caused to move relative to each other in accordance with a rotation of said camshafts thereby to change a compression ratio of said internal combustion engine, said mechanism comprising:

an oil film forming device that forms oil films between said camshafts and the bearing portions rotatably supporting said camshafts, wherein said oil film forming device forms oil films between said camshafts and said bearing portions therefor, respectively, when said camshafts are driven to rotate so as to change the compression ratio of said internal combustion engine.

4. A variable compression ratio mechanism in which a cylinder block and a crankcase of an internal combustion engine are coupled with each other for relative movement, and one or more camshafts are rotatably mounted on bearing portions at which said cylinder block and said crankcase are coupled with each other, so that said cylinder block and said crankcase are caused to move relative to each other in accordance with a rotation of said camshafts thereby to change a compression ratio of said internal combustion engine, said mechanism comprising:

an oil film forming device that forms oil films between said camshafts and the bearing portions rotatably supporting said camshafts, wherein said oil film forming device forms oil films between said camshafts and said bearing portions therefor, respectively, at each predetermined time interval during the time when the rotation of said camshafts for changing the compression ratio of said internal combustion engine is stopped.

5. A method for changing the compression ratio of an internal combustion engine, in which a cylinder block and a crankcase of said internal combustion engine are coupled with each other for relative movement, and a pair of camshafts are rotatably mounted on bearing portions at which said cylinder block and said crankcase are coupled with each other, so that said cylinder block and said crankcase are caused to move relative to each other in accordance with a rotation of said camshafts, said method comprising:

rotating said camshafts thereby to move said cylinder block and said crankcase relative to each other;

estimating an oil film shortage between said camshafts and said bearing portions therefor; and forming oil films between said camshafts and said bearing portions therefor by driving said camshafts to move relative to said bearing portions therefor when an occurrence of said oil film shortage is estimated.

6. A variable compression ratio mechanism in which a cylinder block and a crankcase of an internal combustion engine are coupled with each other for relative movement, and one or more camshafts are rotatably mounted on bearing portions at which said cylinder block and said crankcase are coupled with each other, so that said cylinder block and said crankcase are caused to move relative to each other in accordance with a rotation of said camshafts thereby to change a compression ratio of said internal combustion engine, said mechanism comprising:

an oil film forming device that forms oil films between said camshafts and the bearing portions rotatably supporting said camshafts, wherein said oil film forming device forms oil films between said camshafts and said bearing portions therefor, respectively, by driving said camshafts to move relative to said bearing portions therefor.

7. The variable compression ratio mechanism as set forth in claim 6, wherein said oil film forming device forms oil films between said camshafts and said bearing portions therefor, respectively, when said camshafts begin to rotate so as to change the compression ratio of said internal combustion engine.

8. The variable compression ratio mechanism as set forth in claim 6, wherein said oil film forming device forms oil films between said camshafts and said bearing portions therefor, respectively, when said camshafts are driven to rotate so as to change the compression ratio of said internal combustion engine.

9. The variable compression ratio mechanism as set forth in claim 6, wherein said oil film forming device monitors the driving torque of each of said camshafts when said camshafts are driven to rotate so as to change the compression ratio of said internal combustion engine, and forms oil films between said camshafts and said bearing portions therefor, respectively, when said driving torque becomes a predetermined value or above.

10. The variable compression ratio mechanism as set forth in claim 6, wherein said oil film forming device forms oil films between said camshafts and said bearing portions therefor, respectively, at each predetermined time interval during the time when the rotation of said camshafts for changing the compression ratio of said internal combustion engine is stopped.

11. The variable compression ratio mechanism as set forth in claim 6, wherein said oil film forming device drives said camshafts to move relative to said bearing portions therefor, respectively, by driving said camshafts to rotate reciprocatingly.

12. The variable compression ratio mechanism as set forth in claim 11, wherein said oil film forming device drives said camshafts to move relative to said bearing portions therefor, respectively, by driving said camshafts to reciprocatingly rotate a plurality of times.

13. The variable compression ratio mechanism as set forth in claim 11, wherein said oil film forming device drives said camshafts to move relative to said bearing portions therefor, respectively, by driving said camshafts to rotate reciprocatingly when said camshafts begin to rotate so as to change the compression ratio of said internal combustion engine.

14. The variable compression ratio mechanism as set forth in claim 13, wherein said oil film forming device drives said camshafts to rotate to a predetermined angle in a direction to be rotated to change the compression ratio, and thereafter to return to their original positions, thereby to make a reciprocal motion, which provides a relative movement of the camshafts with respect to said bearing portions.

15. The variable compression ratio mechanism as set forth in claim 11, wherein said oil film forming device forms oil films between said camshafts and said bearing portions therefor, respectively, when said camshafts are driven to rotate so as to change the compression ratio of said internal combustion engine.

16. The variable compression ratio mechanism as set forth in claim 15, wherein said oil film forming device monitors the driving torque of each of said camshafts when said camshafts are driven to rotate so as to change the compression ratio of said internal combustion engine, and forms oil films between said camshafts and said bearing portions therefor, respectively, when said driving torque becomes a predetermined value or above.

17. The variable compression ratio mechanism as set forth in claim 11, wherein said oil film forming device forms oil films between said camshafts and said bearing portions therefor, respectively, at each predetermined time interval during the time when the rotation of said camshafts for changing the compression ratio of said internal combustion engine is stopped.

18. The variable compression ratio mechanism as set forth in claim 11, wherein said oil film forming device drives said camshafts to move relative to said bearing portions therefor, respectively, by driving said camshafts to rotate reciprocatingly during the time when the rotation of said camshafts for changing the compression ratio of said internal combustion engine is stopped, and also said internal combustion engine is in a decelerating operation state.

19. The variable compression ratio mechanism as set forth in claim 6, wherein said oil film forming device drives said camshafts to move relative to said bearing portions therefor, respectively, by driving said camshafts to reciprocate in a direction substantially perpendicular to the axial direction of said camshafts.

20. The variable compression ratio mechanism as set forth in claim 19, wherein said oil film forming device drives said camshafts to move relative to said bearing portions therefor, respectively, by driving said camshafts to reciprocate a plurality of times.

21. The variable compression ratio mechanism as set forth in claim 19, wherein a pair of objects each having a mass are disposed at opposite ends of each of said camshafts; and said camshafts are driven to reciprocate in a direction substantially perpendicular to the axial direction of said camshafts by forcing said objects to collide against said camshafts, respectively, from directions substantially perpendicular to the axial direction of said camshafts.

22. The variable compression ratio mechanism as set forth in claim 6, wherein each of said camshafts and said bearing portions therefor has at least part thereof formed into a tapered configuration, and said oil film forming device drives said camshafts to move relative to said bearing portions therefor, respectively, by driving said camshafts or said bearing portions therefor to axially move back and forth.

23. The variable compression ratio mechanism as set forth in claim 22, wherein said oil film forming device drives said camshafts to move relative to said bearing portions therefor, respectively, by driving said camshafts or said bearing portions therefor to move back and forth a plurality of times.

24. The variable compression ratio mechanism as set forth in claim 22, further comprising:

a temperature detecting device that detects a temperature in the vicinity of said camshafts; and a stop position correcting device that corrects an axial stop position of each of said camshafts or said bearing portions therefor in accordance with the temperature detected by said temperature detecting device.

25. The variable compression ratio mechanism as set forth in claim 22, wherein a pair of objects each having a mass are disposed at opposite ends of each of said camshafts; and said camshafts or said bearing portions therefor are caused to axially move back and forth by forcing said objects to collide against said camshafts, respectively, from the axial direction of said camshafts.

* * * * *